US006694555B2

(12) United States Patent
Soltani et al.

(10) Patent No.: US 6,694,555 B2
(45) Date of Patent: Feb. 24, 2004

(54) AIR FLUIDIZED BLADDERS FOR A BED

(75) Inventors: Sohrab Soltani, Charleston, SC (US); Timothy W. Perez, Charleston, SC (US); James J. Romano, James Island, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 97 days.

(21) Appl. No.: 09/791,436

(22) Filed: Feb. 23, 2001

(65) Prior Publication Data

US 2001/0052152 A1 Dec. 20, 2001

Related U.S. Application Data

(60) Provisional application No. 60/184,992, filed on Feb. 25, 2000, and provisional application No. 60/241,202, filed on Oct. 17, 2000.

(51) Int. Cl.[7] ..... A47C 27/10; A61G 7/057

(52) U.S. Cl. ..... 5/689; 5/702; 5/912

(58) Field of Search ..... 5/689, 702, 714, 5/652.2, 655.4, 911, 912

(56) References Cited

U.S. PATENT DOCUMENTS

| | | | | |
|---|---|---|---|---|
| 4,045,830 | A | 9/1977 | Loeb et al. | 5/81.1 T |
| 4,425,676 | A | 1/1984 | Crane | 5/689 |
| 4,481,686 | A | 11/1984 | Lacoste | 5/689 |
| 4,483,029 | A | 11/1984 | Paul | 5/689 |
| 4,564,965 | A | 1/1986 | Goodwin | 5/689 |
| 4,599,755 | A | 7/1986 | Tominaga | 5/689 |
| 4,609,854 | A | 9/1986 | Yamamoto et al. | 318/471 |
| 4,637,083 | A | 1/1987 | Goodwin | 5/689 |
| 4,638,519 | A | 1/1987 | Hess | 5/713 |
| 4,644,597 | A | 2/1987 | Walker | 5/711 |
| 4,672,699 | A | 6/1987 | Goodwin | 5/430 |
| 4,694,521 | A | 9/1987 | Tominaga | 5/689 |
| 4,768,250 | A | 9/1988 | Kato | 5/689 |
| 4,776,050 | A | 10/1988 | Goodwin | 5/689 |
| 4,803,744 | A | 2/1989 | Peck et al. | 5/713 |
| 4,879,777 | A | 11/1989 | Goodwin | 5/689 |
| 4,914,760 | A | 4/1990 | Hargest et al. | 5/689 |
| 4,942,635 | A | 7/1990 | Hargest et al. | 5/689 |
| 4,951,335 | A | 8/1990 | Eady | 5/709 |
| 4,967,431 | A | 11/1990 | Hargest et al. | 5/689 |
| 4,998,310 | A | 3/1991 | Olson | 5/710 |
| 5,008,965 | A | 4/1991 | Vrzalik | 5/689 |
| 5,009,318 | A | 4/1991 | Lepinoy | 206/524.8 |
| 5,016,304 | A | 5/1991 | Ryhiner | 5/689 |
| 5,020,176 | A | 6/1991 | Dotson | 5/710 |
| 5,029,352 | A | 7/1991 | Hargest et al. | 5/689 |
| 5,036,559 | A | 8/1991 | Hargest | 5/689 |
| 5,105,487 | A | 4/1992 | Hakamiun et al. | 5/689 |
| 5,168,591 | A | 12/1992 | Hakamiun et al. | 5/689 |
| 5,267,364 | A | 12/1993 | Volk | 5/713 |
| 5,325,551 | A | 7/1994 | Tappel et al. | 5/709 |
| 5,367,728 | A | 11/1994 | Chang | 5/689 |
| 5,388,291 | A | 2/1995 | Roux | 5/689 |
| 5,402,542 | A | 4/1995 | Viard | 5/421 |
| 5,539,943 | A | 7/1996 | Romano | 5/655.5 |
| 5,623,736 | A | 4/1997 | Soltani et al. | 5/689 |
| 5,647,079 | A * | 7/1997 | Hakamiun et al. | 5/714 X |

(List continued on next page.)

FOREIGN PATENT DOCUMENTS

| | | |
|---|---|---|
| EP | 0 194 868 A2 | 9/1986 |
| WO | WO 95/31920 | 11/1995 |
| WO | WO 96/33641 | 10/1996 |
| WO | WO 99/21457 | 5/1999 |

*Primary Examiner*—Robert G. Santos
(74) *Attorney, Agent, or Firm*—Bose McKinney & Evans LLP

(57) ABSTRACT

A mattress for a bed is provided to support a patient. The mattress includes a plurality of air fluidized bladders. Each bladder includes a fluidized zone having fluidizable material positioned therein. Each bladder further includes a diffuser configured to provide air to the fluidized zone to fluidize the material.

38 Claims, 34 Drawing Sheets

U.S. PATENT DOCUMENTS

| | | | | | |
|---|---|---|---|---|---|
| 5,655,239 | A | | 8/1997 | Caparon et al. | 5/713 |
| 5,682,827 | A | | 11/1997 | Nagato et al. | 110/244 |
| 5,699,570 | A | | 12/1997 | Wilkinson et al. | 5/713 |
| 5,740,573 | A | | 4/1998 | Boyd | 5/711 |
| 5,755,000 | A | | 5/1998 | Thompson | 5/713 |
| 5,781,943 | A | | 7/1998 | Moenning et al. | 5/81.1 C |
| 5,815,865 | A | | 10/1998 | Washburn et al. | 5/713 |
| 5,855,207 | A | | 1/1999 | Moenning et al. | 128/845 |
| 5,966,763 | A | | 10/1999 | Thomas et al. | 5/715 |
| 6,006,383 | A | | 12/1999 | Pile et al. | 5/706 |
| 6,016,581 | A | | 1/2000 | Miki | 5/689 |
| 6,131,214 | A | * | 10/2000 | Moenning et al. | 5/702 X |
| 6,192,537 | B1 | * | 2/2001 | Miki | 5/689 |
| 6,351,862 | B1 | * | 3/2002 | Henley et al. | 5/689 X |
| 2001/0052152 | A1 | * | 12/2001 | Soltani et al. | 5/689 |
| 2002/0083529 | A1 | * | 7/2002 | Henley et al. | 5/689 |

* cited by examiner

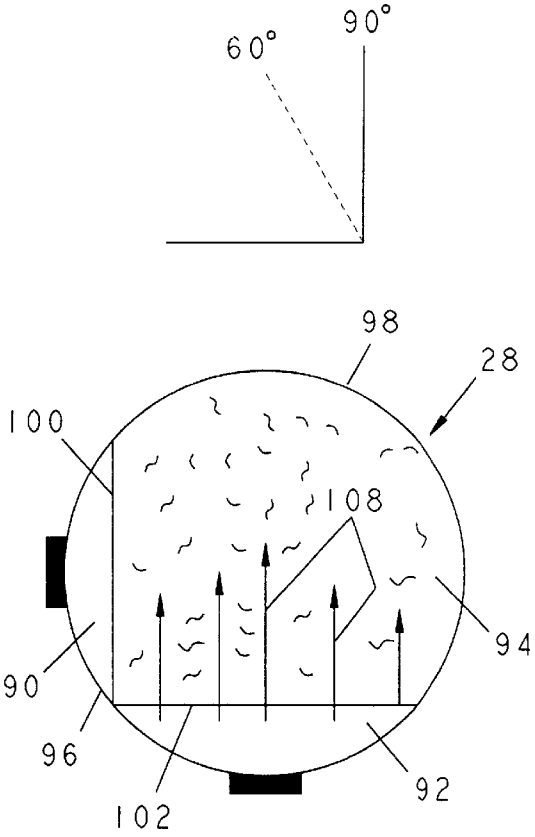
FIG. 3
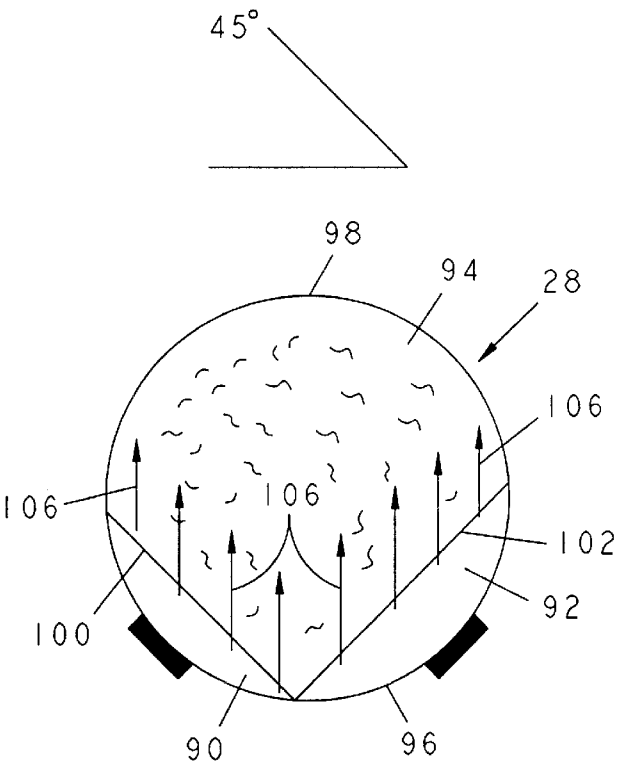
FIG. 4
FIG. 5

AIR FLUIDIZED BLADDERS FOR A BED

This application claims benefit of U.S. Provisional Application Serial No. 60/184,992, filed Feb. 25, 2000, titled Support Surface Having Air Fluidized Bladders, and U.S. Provisional Application Serial No. 60/241,202, filed Oct. 17, 2000, titled Air Fluidized Bladders for a Bed, the disclosures of which are expressly incorporated by reference herein.

BACKGROUND AND SUMMARY OF THE INVENTION

The present invention relates to a support surface having air fluidized bladders for supporting a patient. More particularly, the present invention relates to air fluidized bladders which can be articulated on a deck to different angular orientations while remaining air fluidized.

Air fluidized sections in patient supports are well known. Such air fluidized sections provide reduced pressure against the patient's body resting on the support surface. Air fluidized sections are typically supplied with air from a blower to move a fluidizable medium located within the air fluidized sections. In this type of support surface, a fluidizable medium such as tiny spheres of glass, ceramics, or silicone are contained within a suitable support and fluidized by passing air through the support to support the patient. In a common design, the fluidizable medium is supported by a diffuser board which is permeable to air but impermeable to the fluidizable medium. A retaining mechanism which is impermeable to air is positioned around the outer edge of the diffuser board. A cover encloses the fluidizable medium and is permeable only to air flow.

Conventional air fluidized beds must be operated in a generally horizontal or flat orientation. Air flowing through plenums and diffusers within conventional air fluidized beds will typically not be properly fluidized when the diffusers are located at an angle.

According to the present invention, a fluidized bladder for use with a bedframe is provided. The fluidized bladder includes an outer wall, a plurality of diffusers cooperating with the outer wall to define a fluidized zone, and a fluidizable medium positioned in the fluidized zone. The plurality of diffusers are configured to provide air to the fluidized zone to fluidize the fluidizable medium.

According to another embodiment of the present invention, a fluidized air bladder for use with a bedframe is provided. The fluidized bladder includes an outer wall, a diffuser apparatus cooperating with the outer wall to define a fluidized zone, and a fluidizable medium positioned in the fluidized zone. The diffuser is configured to provide air to fluidize the fluidizable medium in a first flow direction. The diffuser apparatus is also configured to provide air to fluidize the fluidizable medium in a second flow direction. The first and second flow directions cooperate to define an angle therebetween of more than 60 degrees.

According to another embodiment of the present disclosure, a fluidized bladder for use with a bedframe is provided. The fluidized bladder includes an outer wall, a diffuser apparatus cooperating with the outer wall to define a fluidized zone, and a fluidizable medium positioned in the fluidized zone. The diffuser apparatus is configured to provide air to the fluidized zone to fluidize the fluidizable medium. A portion of the air leaves the diffuser apparatus in a first flow direction passing through a point in the fluidized zone. Another portion of the air leaves the diffuser apparatus in a second flow direction passing through the point.

According to another embodiment of the present disclosure, a fluidized bladder for use with a bedframe is provided. The fluidized bladder includes an outer wall, a diffuser having a convex surface cooperating with the outer wall to define a fluidized zone, and a fluidizable medium positioned in the fluidized zone, the convex surface of the diffuser providing air to the fluidized zone to fluidize the fluidizable medium.

According to another embodiment of the present disclosure, a support surface apparatus for use with a bedframe is provided. The bedframe includes a first deck section and a second deck section configured to move relative to the first deck section. The support surface apparatus includes a fluidized air bladder including an outer wall, a diffuser cooperating with the outer wall to define a fluidized zone, and a fluidizable medium positioned in the fluidized zone. The diffuser provides air to the fluidized zone to fluidize the fluidizable medium. The support surface apparatus further includes a mechanism adapted to move the diffuser relative to the bedframe to maintain fluidized of the fluidizable medium.

According to another embodiment of the present disclosure, a support surface apparatus for use with a bedframe is provided. The bedframe includes an articulating deck including a deck section configured to move from a first substantially horizontal position to an inclined position. The support surface apparatus includes a fluidized bladder including an outer wall, a diffuser apparatus cooperating with the outer wall to define a fluidized zone, and a fluidizable medium positioned in the fluidized zone. The diffuser apparatus provides air to the fluidized zone to fluidize the fluidizable medium. The support surface apparatus further includes an air supply configured to adjust the flow of air through portions of the diffuser apparatus as a result of movement of the deck section of the bedframe.

According to another embodiment of the present invention, a fluidized bladder for use with a bedframe is provided. The bedframe includes an articulating deck including a deck section configured to move from a first substantially horizontal position to an inclined position of at least 15°. The fluidized bladder includes an outer wall, a diffuser apparatus cooperating with the outer wall to define a fluidized zone, and a fluidizable medium positioned in the fluidized zone. The diffuser apparatus is configured to provide air to the fluidized zone in a substantially vertical direction when the deck section is in the inclined position to maintain the fluidization of the fluidizable medium.

According to another embodiment of the present invention, a support surface apparatus for use with a bedframe is provided. The bedframe includes an articulating deck including a deck section configured to move from a first substantially horizontal position to an inclined position of at least 15°. The support surface apparatus includes an outer wall defining an interior region having a fluidized zone, a fluidizable medium positioned in the fluidized zone, and means for providing air to the fluidized zone to fluidize the fluidizable medium. The providing means is configured to maintain at least a portion of the air flow in a substantially vertical direction through a central portion of the fluidized zone when the deck is in the inclined position.

Additional features of the present invention will become apparent to those skilled in the art upon consideration of the following detailed description of the presently perceived best mode of carrying out the invention.

BRIEF DESCRIPTION OF THE DRAWINGS

The detailed description particularly refers to the accompanying figures in which:

FIGS. 3–5 are diagrammatical views illustrating the orientation of the air fluidized bladders located on the head section which include first and second plenums and an air fluidized zone when the head section is positioned at a 0° angle as shown in FIG. 3, a 45° angle as shown in FIG. 4, and a 90° angle as shown in FIG. 5;

DETAILED DESCRIPTION OF THE DRAWINGS

Figure 1:
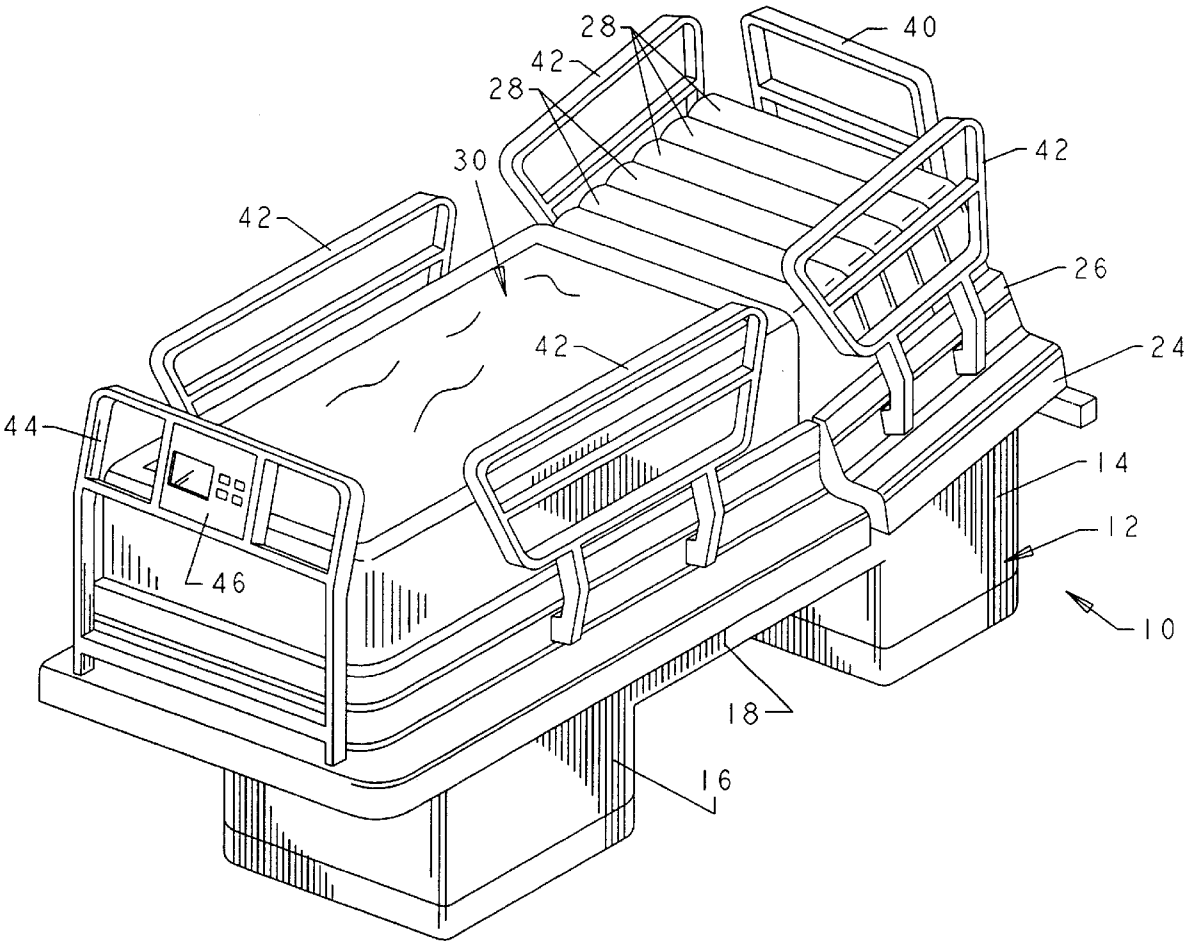
FIG. 1 is a perspective view of a hospital bed of the present disclosure including a plurality of air fluidized bladders located on an articulating head section of the bed and a larger air fluidized region located below the feet, legs, and seat of the patient.
Figure 2:
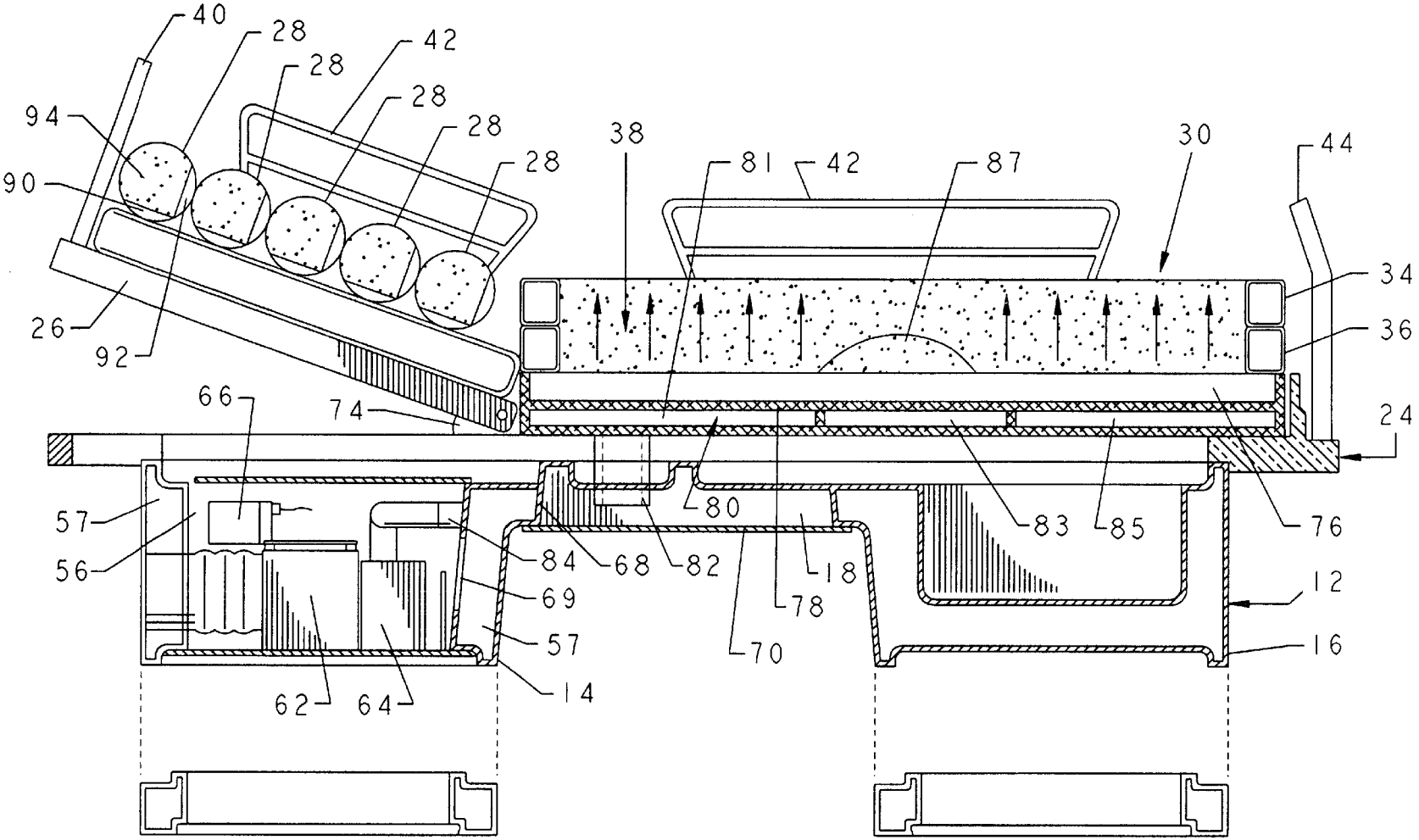
FIG. 2 is a sectional view taken through the bed of FIG. 1 illustrating details of the air fluidized bladders located on the head section of the bed and details of the air fluidized section located below the seat, legs and feet of the patient.

Referring now the drawings, FIGS. 1 and 2 illustrate a bed 10 in accordance with one embodiment of the present disclosure. Bed 10 includes a base 12 having first and second pedestals 14, 16 and a connecting midsection 18. An upper frame assembly or deck 24 is positioned on top of base 12. Upper frame assembly 24 includes an articulatable head section 26 which can be inclined and lowered up to 60° to raise and lower a patient's head.

A mattress or support surface of bed 10 includes a plurality of air fluidized bladders 28 located on head section 26 and an air fluidized support portion 30 located on upper frame 24 at a location toward a foot end of bed 10 from head section 26. Bed 10 also includes a headboard 40, a plurality of siderails 42, and a footboard 44. A control panel 46 is used to control bed 10 in a conventional manner. It is understood that any type of control system may be used in accordance with the present disclosure.

In the illustrated embodiment, air fluidized section 30 includes a pair of inflatable rings 34, 36 surrounding a central air fluidized region 38. Also, in the illustrated embodiment, most of the major electrical and mechanical components for operating bed 10 are contained within blower compartment 56. These components include a blower heat exchanger assembly 62, a heater 64, and pressure control valves 66. A space 57 between the double walls of pedestal 14 provides insulation against noises from blower 62 and other components located within compartment 56. An aperture 68 is formed in the bottom of midsection 18 to provide an air inlet for blower heat exchanger assembly 62. Aperture 69 is formed in interior wall base 12 to permit air flow to pass from aperture 68 to an air intake of blower/heat exchanger assembly 62. An air filter 70 is placed over aperture 68 to clean the incoming air.

Air fluidized bed portion 30 includes a diffuser plate 76 which is permeable to air but impermeable to the fluidizable medium which in the preferred embodiment, comprises tiny glass beads or microspheres. A perforated plate 78 is positioned beneath diffuser plate 76 to provide additional support strength. A plenum 80 is connected by inlet 82 to pipe 84 and blower compartment 56 by suitable piping (not shown) which conducts heated air to fluidized bed section 30. Plenum 80 includes separate sections 81, 83, 85 as discussed below. Further details of bed 10 are disclosed in U.S. Pat. No. 5,623,736, which is expressly incorporated herein by reference.

Head section 26 is coupled to upper frame 24 by a suitable hinge 74. Articulating of head section 26 is controlled in a suitable manner to move head section 26 from a flat, generally horizontal position to an inclined or elevated position to raise a patient's head.

In the present disclosure, air fluidized bladders 28 are capable of maintaining air fluidization within bladders 28 as head section 26 is inclined. To accomplish this continuous air fluidization, each of bladders 28 includes a first plenum 90 defined by a first air zone and a second plenum 92 defined by a second, separate air zone. A third zone 94 contains the fluidizable medium. Bladders 28 include an outer wall having a bottom air impermeable outer sheet 96 shown in FIGS. 3–5 and upper air permeable outer sheet 98. Plenum 90 is formed by an air permeable and fluidizable medium impermeable sheet or diffuser 100 of a diffuser apparatus coupled along opposite sides to impermeable outer sheet 96. Second plenum 92 is formed by an air permeable and fluidizable impermeable sheet or diffuser 102 which is coupled along opposite sides to air impermeable outer sheet 96.

In the embodiment of FIGS. 3–5, diffusers 100, 102 are aligned at about a 90° angle as shown by angle 91 to define a V-shaped concave diffuser surface. When head section 26 is in a generally horizontal flat position, air is supplied to plenum 90 only so that air flows vertically upward in the direction of arrows 104 in FIG. 3 to fluidize the fluidizable medium within zone 94 and provide support for the patient.

As head section 26 is inclined, air flow is gradually shifted from first plenum 90 to second plenum 92. When head section 26 is aligned at an angle about 45°, air flow from the blower is supplied substantially equally to first and second plenums 90, 92. Air exits first plenum 90 in a first flow direction that is substantially parallel to diffuser 102. Similarly, air exits second plenum 92 in a second flow direction that is substantially parallel to diffuser 100. Because diffusers 100, 102 define an angle of 90°, the first and second air flow direction also define an angle therebetween of 90°. The flow of air in the first and second air flow directions merge so that air flows vertically in the direction of arrows 106 shown in FIG. 4 upwardly through the fluidizable medium in zone 94.

Once head section is inclined beyond 45° as shown in FIG. 5, air is supplied from a blower mainly or entirely to second plenum 90 so that air flows vertically upward through diffuser 102 in the direction of arrows 108 to fluidize the fluidizable medium within zone 94.

It is understood that plenums 90, 92 can be aligned at any suitable angles. In addition, more than two plenums may be used inside bladders 28, if desired. According to one alternative embodiment of the present disclosure, only one plenum is provided.

Figure 6:
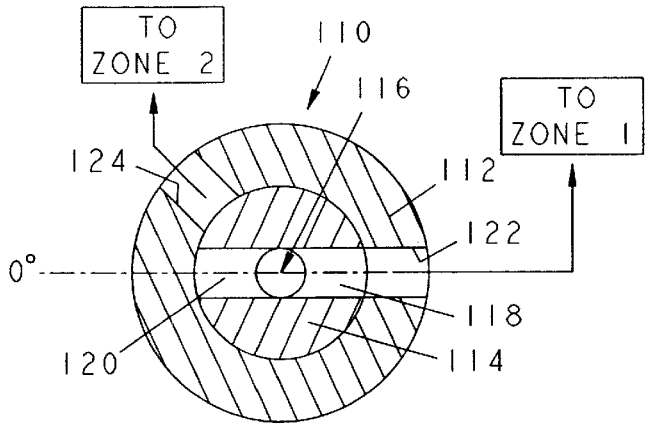
FIGS. 6–8 illustrate positions of a valve configured to supply air to the first and second plenums of the fluidized air bladders shown in FIGS. 1–5.
Figure 7:
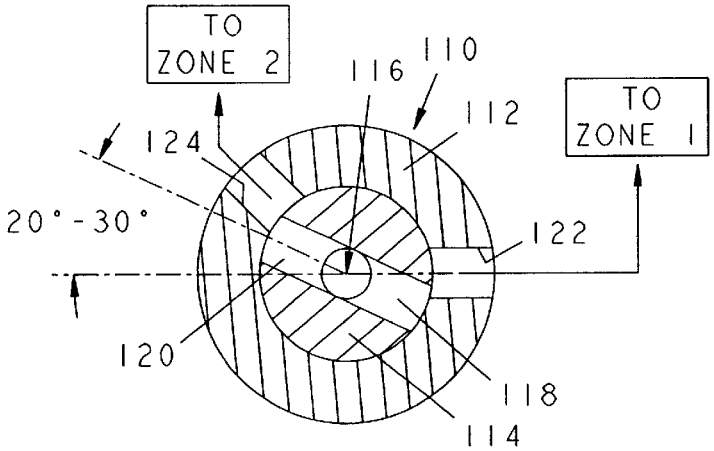
Figure 8:
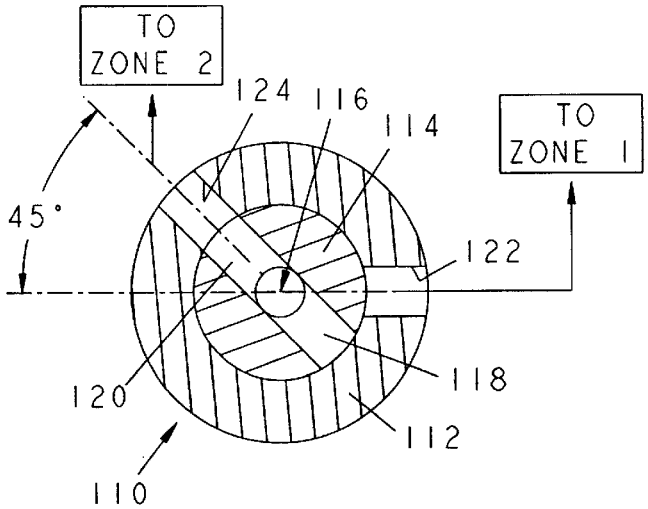

An air flow control valve 110 for controlling air flow to the first and second plenums is illustratively shown in FIGS. 6–8. Valve 110 includes an outer stator portion 112 and an inner rotor portion 114. Stator portion 112 remains fixed while rotor portion 114 rotates as head section 26 is inclined. Rotor 114 includes an air inlet 116 coupled to blower 62. Rotor 114 includes first and second passageways 118, 120 extending outwardly from inlet 116. Stator 112 includes openings 122, 124, respectively. Opening 122 is coupled to the first zone which is illustratively first plenum 90. Opening 124 is coupled to a second zone which is illustratively second plenum 92.

FIG. 6 illustrates air flow when head section 26 is in a horizontal or flat orientation. All the air flow is directed from inlet 116 through passageway 118 and opening 122 and then to first plenum as shown in FIG. 6.

FIG. 7 illustrates the position of valve 110 when head section 26 is rotated at an angle of about 20° to about 30°. Rotor 114 is rotated so that a portion of passageway 118 is aligned with aperture 122 and a portion of passageway 120 is aligned with opening 124. Therefore, part of the air supply to inlet 116 is transmitted to first plenum 90 through opening 122 and part is transmitted through opening 124 to second plenum 92. FIG. 5 illustrates air flow when head section 26 is rotated at about 45°. At this point, all the air from inlet 116 is directed through passageway 120 and opening 124 to second plenum 92. Air flow through passageway 118 is blocked and does not pass through opening 122. According to an alternative embodiment of the present disclosure, air is supplied to both plenums regardless of the position of the respective section of the deck.

As shown in FIG. 3, diffuser 100 directs air in multiple parallel flow directions as it leaves diffuser 100 into fluidization zone 94. Similarly, diffuser 102 directs are along multiple parallel flow directions as it leave diffuser 102 into fluidization zone 94 as shown in FIG. 5. When pressurized air is supplied to both diffusers 100, 102, the multiple parallel flow directions created by diffuser 100 intersect the multiple flow direction created by diffuser 102 at multiple points in fluidization zone 94. Thus, multiple points exists in fluidization zone 94 through which at least two flow directions meet. At least one of these points is located at the center of fluidization zone 94. A plurality of these points are located at a center portion of fluidization zone 94. Furthermore, a plurality of these points are located adjacent to sheet 98. Thus, air from two sources is initially directed at most points in fluidization zone 94 to assist fluidization of the fluidizable medium when both diffusers 100, 102 are provided with pressurized air.

Figure 9:
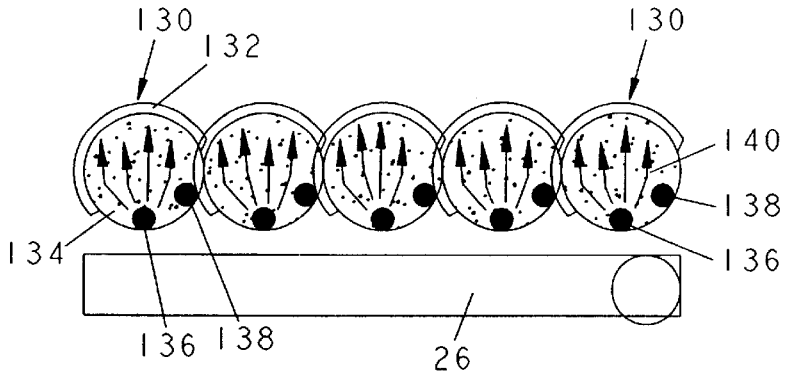
FIG. 9 is a diagrammatical view of another embodiment of the present disclosure with the head section in a horizontal orientation and with air being supplied to a first air permeable tube located within each of the plurality of air fluidized bladders.
Figure 10:
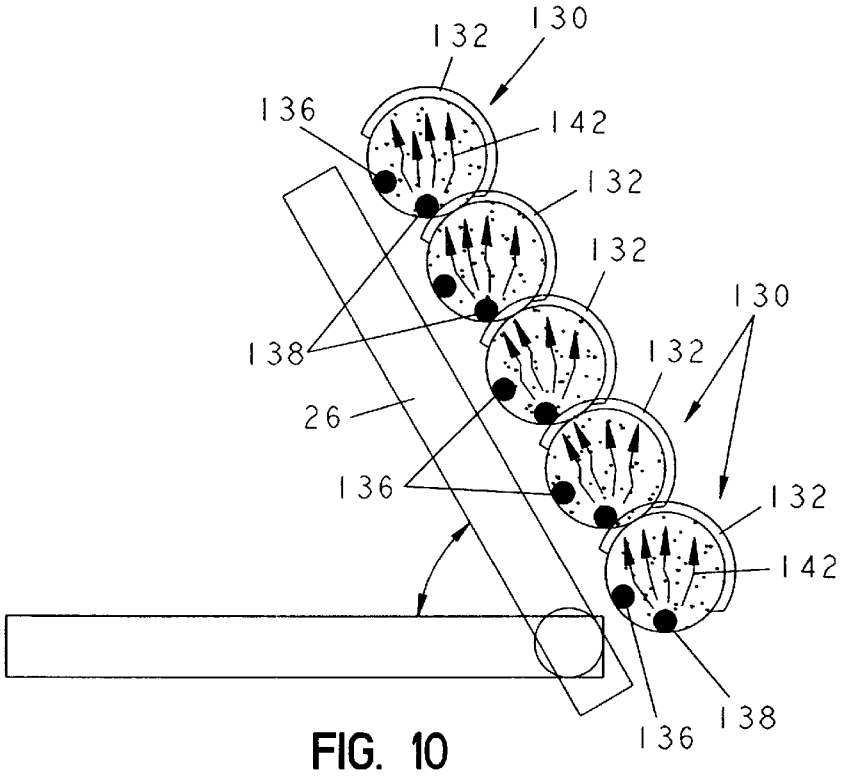
FIG. 10 is a diagrammatical view illustrating the embodiment shown in FIG. 9 with the head section in an inclined position and with air being supplied to a second air permeable tube located within each of the air fluidized bladders.

FIGS. 9 and 10 are diagrammatical illustrations of another embodiment of the present disclosure. In this embodiment, air fluidized bladders 130 include an outer wall having a top air permeable and air fluidizable material impermeable sheet 132 and an air impermeable bottom portion 134 coupled thereto. Air permeable tubes or diffusers 136, 138 of a diffuser apparatus are located within bladders 130 at spaced apart locations.

When head section 26 is located in the horizontal flat position, air is supplied from a blower through first tubes 136 so that air flows upwardly as illustrated by arrows 140 in FIG. 9 to provide air fluidization within bladders 130. When the head section 26 is inclined as shown in FIG. 10, air is supplied from the blower to second tubes 138 so that air flows upwardly in the direction of arrows 142. As discussed above, air flow may be transitioned from tube 136 to tube 138 gradually as head section 26 is inclined.

Figure 11A:
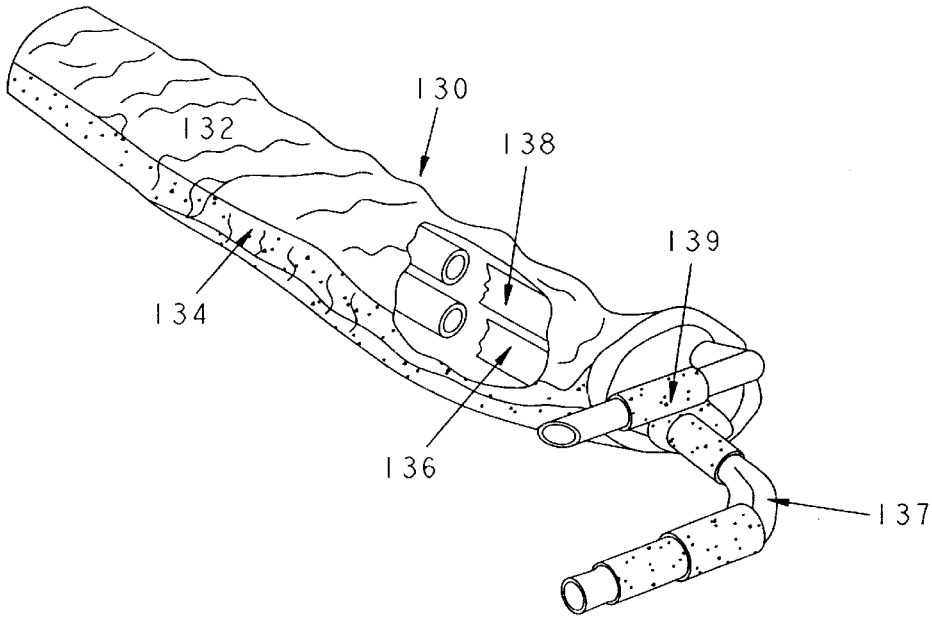
FIGS. 11A and 11B are perspective views of air bladders of the embodiments of FIGS. 9 and 10.
Figure 11B:
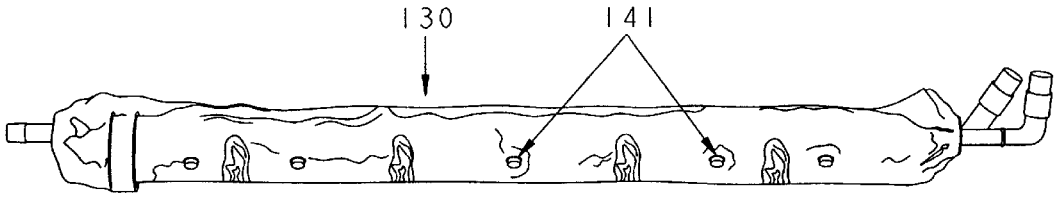

The elongated tubes 136, 138 are illustrated in FIG. 11A. Air is supplied from the blower to tube 136 through inlet 137. Air is supplied from the blower to tube 138 through inlet 139. Snaps 141 shown in FIG. 11B are used to secure bladders 130 to a support located beneath bladders 130.

As shown in FIG. 9, tube 136 has a convex surface that directs air in multiple non-parallel flow directions into the fluidization zone from a single point of origin. Similarly, diffuser tube 138 directs air in multiple non-parallel flow directions into the fluidization zone from a single point of origin as shown in FIG. 10. When pressurized air is supplied to both tubes 136, 138, many of the multiple non-parallel flow directions created by tube 136 intersect the multiple flow direction created by tube 138 at multiple points in the fluidization zone. Thus, multiple points exists in the fluidization zone through which at least two flow directions meet. At least one of these points is located at the center of the fluidization zone. A plurality of these points are located at a center portion of the fluidization zone. Furthermore, a plurality of these points are located adjacent to sheet 132. Thus, air from two sources is initially directed at many points in the fluidization zone to assist fluidization of the fluidizable medium when both tubes 136, 138 are provided with pressurized air.

Figure 12:
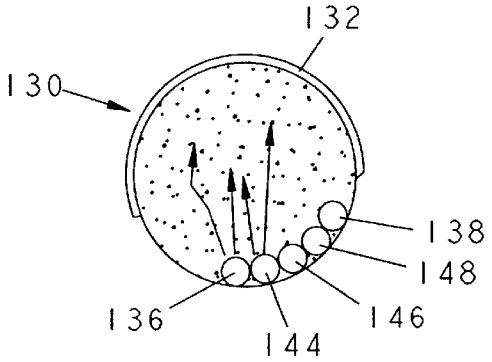
FIG. 12 is a sectional view of another embodiment of the present disclosure similar to FIGS. 9–11B.

FIG. 12 illustrates another embodiment of the present disclosure which includes additional air permeable tubes or diffusers 144, 146, 148 of a diffuser apparatus located between tubes 136, 138. It is understood that any suitable number of air permeable tubes may be used within bladders 130 to provide suitable air flow for fluidization during articulation. Air flow can either be transmitted entirely from one tube to the next tube as the head section is raised or can be gradually transitioned between tubes as the head section is raised.

Figure 13:
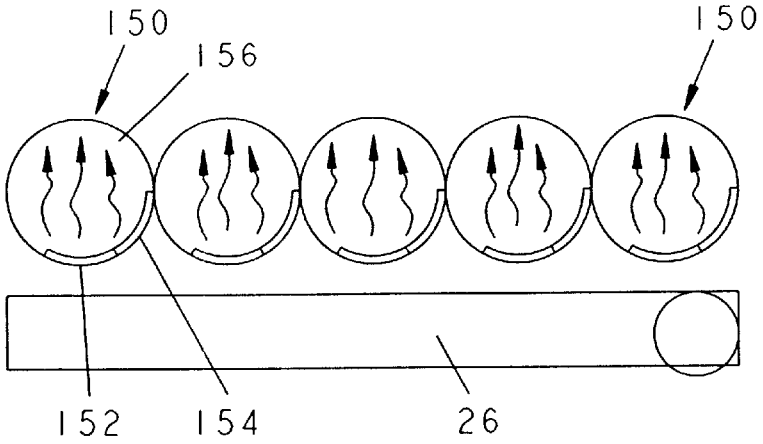
FIG. 13 is a diagrammatical view of yet another embodiment of the present disclosure with the head section shown in a horizontal orientation and with air being supplied to a first plenum.
Figure 14:
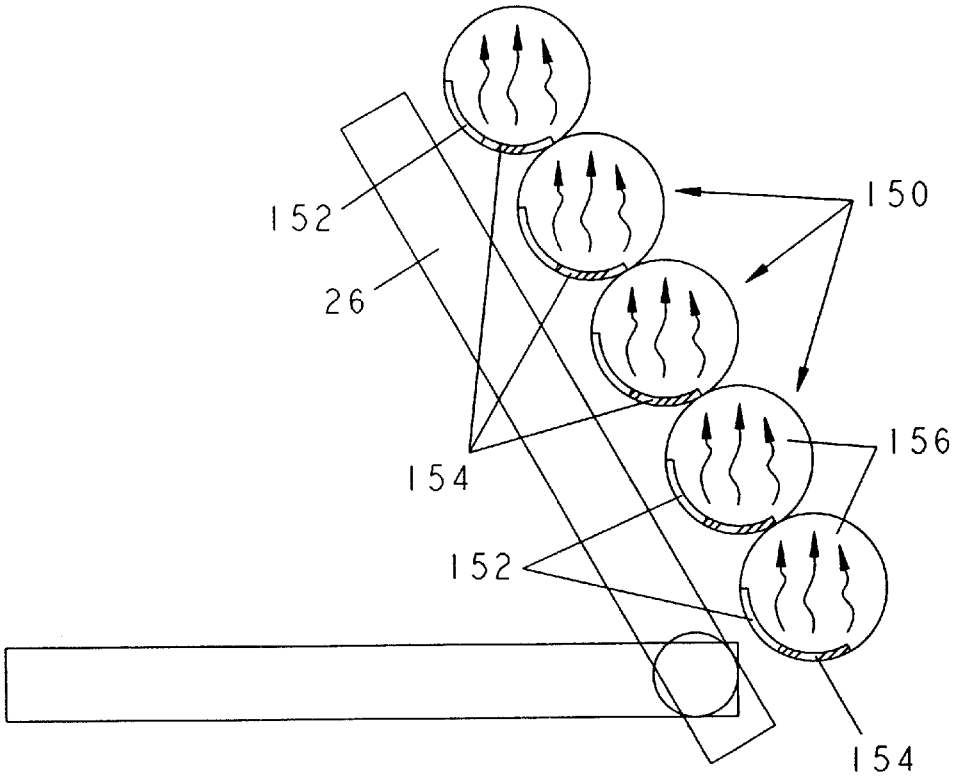
FIG. 14 is a diagrammatical view of the embodiment shown in FIG. 13 with the head section inclined and with air being supplied to the second plenum to continue air fluidization when the head section is in an inclined orientation.
Figure 15:
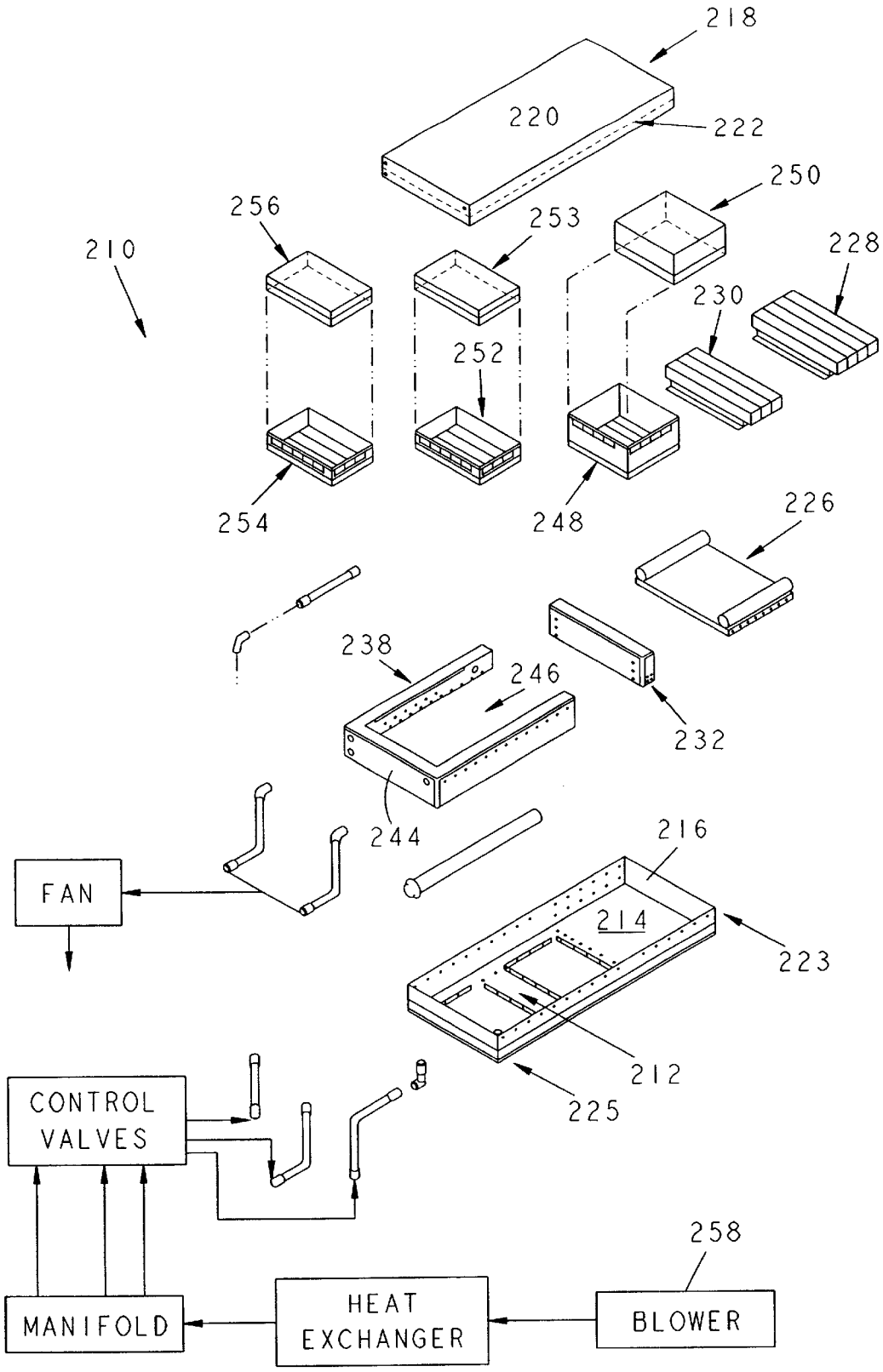
FIG. 15 is an exploded perspective view of another embodiment of the present disclosure in which a mattress includes a plurality of air fluidized sections.

Another embodiment of the present disclosure is illustrated in FIGS. 13 and 14. This embodiment, air bladders 150 include first and second plenums 152, 154 and a fluidized zone 156 and diffusers positioned between first and second plenums 152, 154 and fluidized zone 156. As discussed above, air is supplied to first plenum 152 when head section 26 is in a horizontal flat orientation as shown in FIG. 13. When head section 26 is inclined as shown in FIG. 14, air is supplied to plenum 154. Air is transitioned between plenum 152 and plenum 154 as the head section is inclined as discussed above. The diffusers have concave diffuser surfaces that direction air along flow directions that intersect at various points within the fluidization zone similar to those discussed above.

The air fluidized bladder embodiments discussed above with reference to FIGS. 1–14 maintain fluidization within each bladder when the bladder is aligned at different angles by positioning diffuser material sheets at angular different locations within the bladder. By positioning two diffusers 100, 102 at a 90° angle as shown in FIGS. 2–5, 90° of rotation can be achieved for bladders 28.

According to alternative embodiments of the present disclosure, other angles are provided to accommodate other angles of inclination. For example, In another embodiment of the present disclosure, diffusers 100, 102 are aligned at a 120° angle. This embodiment permits fluidization through rotation of a head section to about 60°. In this embodiment, air is supplied to the first plenum at 100% when the angle is at 0°. At 30° inclination, air is illustratively supplied at 50% to the first plenum and 50% to the second plenum. Finally, at 60°, air is supplied at 100% to the second plenum.

Referring again to FIG. 2, plenum 80 is separated into independently controlled zones 81, 83, 85 located beneath the seat section, knee section, and foot sections, respectively. In one embodiment, air is supplied from blower 62 only to sections 81, 85 of plenum 80 when head section 26 is raised. In other words, when head section 26 is raised, air flow to central plenum section 83 is stopped. This non-fluidized section creates a pile of fluidizable material 87 which provides a knee gatch within fluidized region 30 when head section 26 is inclined. When head section 26 returns to a horizontal position, air is again supplied to plenum section 83 to fluidize the knee area of bed 10.

Another embodiment of the present disclosure is illustrated in FIGS. 15–18. The embodiment of FIGS. 15–18 is similar to a mattress structure disclosed in U.S. patent application Ser. No. 09/177,772, filed Oct. 23, 1998, and titled Mattress Replacement Having Air Fluidized Sections, which is expressly incorporated herein by reference. Mattress 210 is configured to be supported on any bedframe or other support surface. Mattress 210 includes a bottom cover 212 having a bottom surface 214 and a sidewall 216. Bottom cover 212 includes a head end 223 and a foot end 225. Mattress 210 also includes a top cover 218 having a top surface 220 and a downwardly extending sidewall 222. Top cover 218 is secured to bottom cover 212 with a suitable fastener such as a zipper, snaps, or other coupling mechanism.

An air support bladder 226 is located within an interior region of bottom cover 212 adjacent head end 223. Mattress 210 further includes air fluidized head bladders 228 and air fluidized shoulder bladders 230. Bladders 228, 230 are illustratively air fluidized as discussed below or as discussed in reference to any of the embodiments described herein. A lumbar air bladder 232 is located adjacent shoulder fluidized bladders 230. An air fluidized seat section 248 is located within a center space 246 defined by an air wall bladder 238. A seat section cover 250 is coupled to air fluidized seat section 248. An air fluidized knee section 252 is located within center space 246 adjacent seat section 248. Cover 253 is located over air fluidized knee section 252. An air fluidized foot section 254 is located within the center space of the air wall bladder between knee section 254 and an end wall 244. Foot zone cover 256 is coupled over air fluidized foot section 254. Air from blower 258 is supplied to air fluidized sections 228, 230, 248, 252, 254 to provide fluidization within each of regions of mattress 210.

Figure 16:
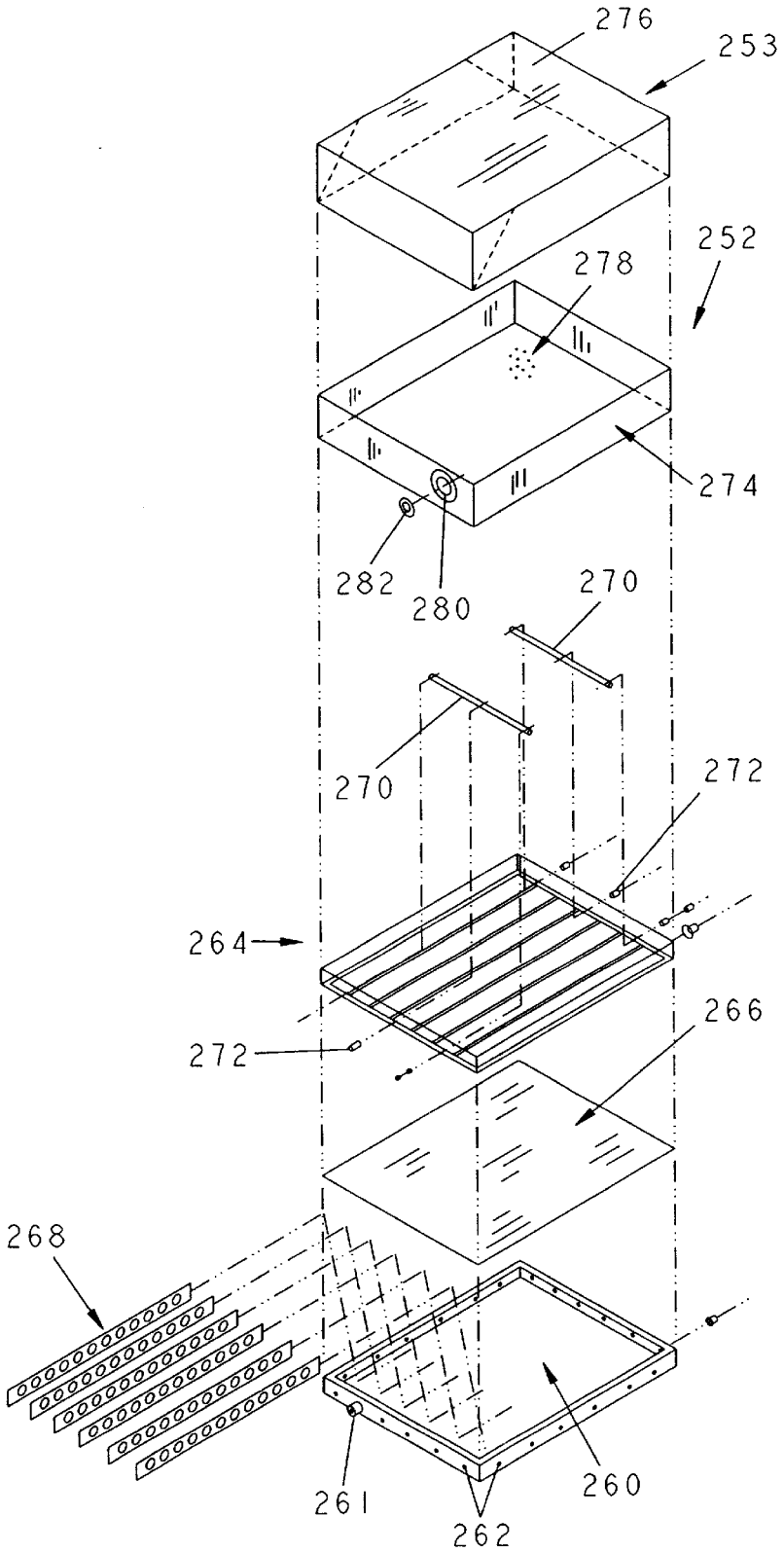
FIG. 16 is an exploded perspective view of one of the air fluidized sections of FIG. 15.

Additional details of air fluidized knee section 252 are illustrated in FIG. 16. A base 260 has a generally rectangular shape. A plurality of snaps 262 or other fasteners are provided to secure air fluidized knee zone 252 to adjacent bladders and to cover 212. A frame 264 is configured to secure a diffuser sheet or diffuser 266 of a diffuser apparatus to base 260. Base 260 and frame 264 are illustratively made of a material impervious to air. A plurality of baffles 268 are coupled between diffuser sheet 266 and a bottom wall of base 260. Baffles 268 maintain the height of a plenum during operation. Air is supplied to the plenum through inlet 261. Metal strips 270 are coupled to opposite side walls of frame 264 by suitable fasteners 272. Diffuser sheet 266 is illustratively formed from a suitable material to permit controlled air flow through sheet 266. A side wall 274 which is impervious to air is coupled to frame 264. At least a top surface 276 of cover 253 is formed from an air permeable material. Side wall 274 is coupled to cover 253. A fluidizable medium 278 is loaded into the interior region by unzipping cover 253. Fluidizable medium 278 can also be loaded through aperture 280 and side wall 274 by removing cap 282.

Figure 17:
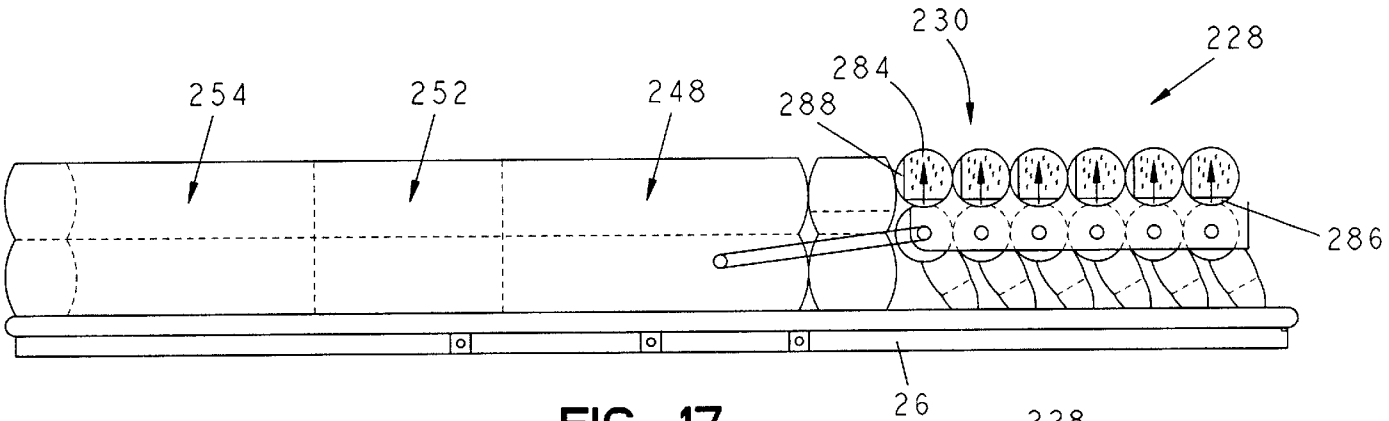
FIG. 17 is a partial sectional view of a mattress similar to the mattress of FIG. 15 illustrating the locations of each of the air fluidized sections.
Figure 18:
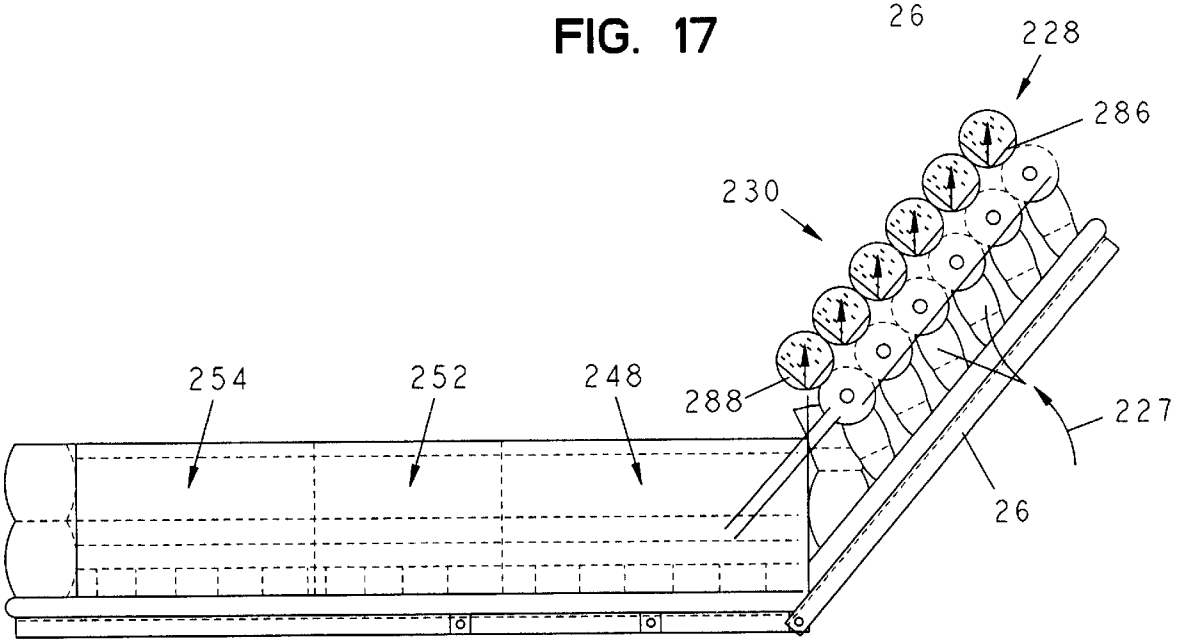
FIG. 18 is a view similar to FIG. 17 in which a head section of the mattress has been inclined.
Figure 19:
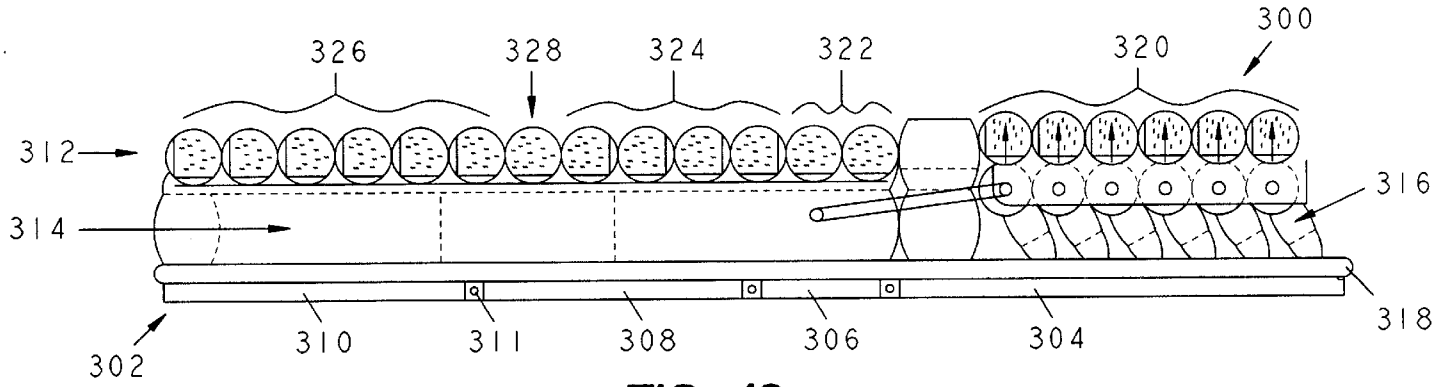
FIG. 19 is a partial sectional view of another embodiment of the present disclosure illustrating a mattress having a plurality of individual air fluidized bladders extending transversely across the mattress.

As shown in FIGS. 17 and 18, each of bladders 228, 230 includes a first zone 284 configured to receive fluidizable medium therein. Bladders 228, 230 also include first and second plenums 286, 288 so that air fluidized bladders 228, 230 can be operated in both a flat, horizontal orientation as shown in FIG. 17 with air flowing through first plenums 286 and in an inclined position shown in FIG. 18 with air flowing at least partially through second plenums 288. It is understood that any of the air bladder structures disclosed herein may be used in place of air bladders 228, 230 in mattress 210. FIGS. 17 and 18 also illustrate the orientation of fluidized sections 248, 252, 254 which support the seat, knee, and foot sections of a patient, respectively. It is understood that when head section 26 is moved to the inclined or elevated position in the direction of arrow 227 shown in FIG. 18, fluidization may be stopped within knee section 252 to provide a knee gatch feature.

Another embodiment of the present disclosure is illustrated in FIGS. 19–24. In this embodiment, a mattress 300 is located on a frame or deck 302 having head, seat, thigh, and foot sections 304, 306, 308, 310. Frame 302 is movable from a flat orientation shown in FIG. 19 to an articulated or inclined orientation shown in FIG. 20. Mattress 310 includes a plurality of separate air fluidized air bladders 312 located on a top portion of mattress 310. Suitable support portions 314, 316 are located under air fluidized bladders 312. Support portions 314, 316 may be air bladders, foam, or other suitable support structures. A base 318 of mattress 300 rests upon deck 302.

Figure 20:
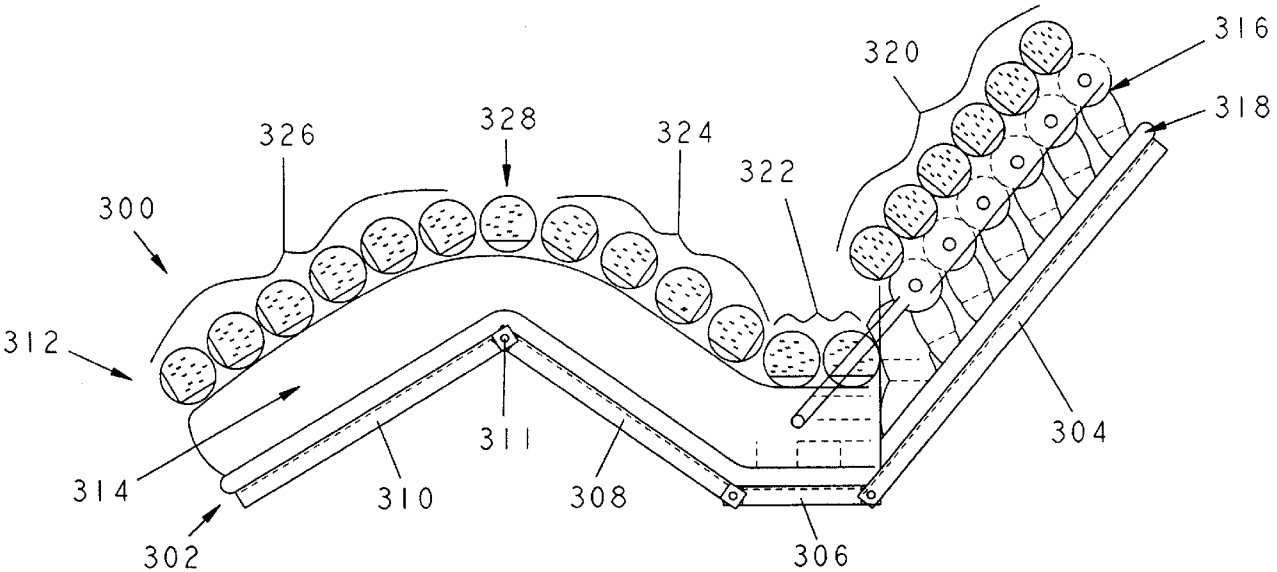
FIG. 20 is a partial sectional view similar to FIG. 19 in which the head section and knee section of the mattress are inclined.

Air fluidized bladders 312 include head, seat, thigh, and calf and foot zone bladders 320, 322, 324, 326. Bladders in head, thigh, and calf and foot zone bladders 320, 324, 326 include first and second plenums as discussed above. These multiple plenums are used since these bladders 320, 324, 326 move to different inclined positions during articulation of frame 302 as shown in FIG. 20. Bladders and seat section 322 illustratively include only a single plenum. In addition, at least one bladder 328 between thigh zone bladders 324 and calf and foot zone bladders 326 includes only one plenum since this bladder remains substantially horizontal above a pivot connection 311. It is understood that bladders 312 and supports 314, 316 are all located within a cover (not shown).

Figure 21:
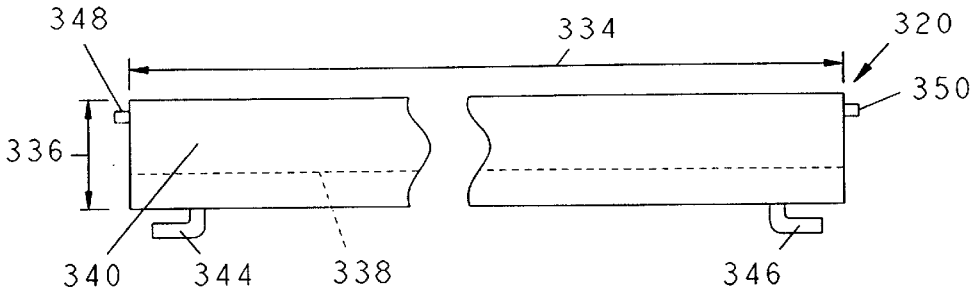
FIG. 21 illustrates another embodiment of an air fluidized bladder including first and second plenums.
Figure 22:
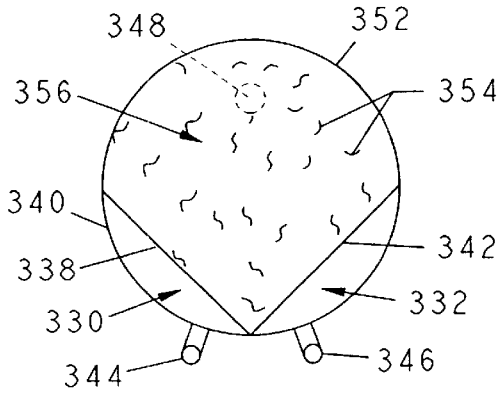
FIG. 22 is a sectional view taken through the air bladder of FIG. 21.

Bladders which may also be used within mattress 300 are shown in FIGS. 21–24. FIGS. 21 and 22 illustrate air fluidized bladder 320 having first and second plenums 330, 332. Bladders 320 have a length dimension 334 which is illustratively about 30 inches and a diameter 336 which is illustratively three inches. First plenum 330 is formed by a diffuser sheet or diffuser 338 of a diffuser apparatus which runs the length of bladder 320 and has a width of about 2.5 inches. Opposite sides of diffuser sheet 338 are coupled to outer wall 340 of bladder 320. Second plenum 332 is formed by diffuser sheet 342 which is coupled along opposite sides to outer sheet 340. A first inlet tube 344 is coupled to outer wall 340 in communication with first plenum 330. A second inlet tube 346 is coupled to outer wall 340 in communication with second plenum 332. Snaps 348, 350 are located at opposite ends of bladder 320 to secure the bladders to a side wall of a cover. A top surface 352 of bladders 320 is air permeable. Therefore, fluidizable material 354 located within interior region 356 is fluidized by air passing through plenums 330, 332. Diffusers 338, 342 cooperate to define a concave diffuser surface and direct air in flow directions that intersect at points within the fluidization zone similar to those discussed above.

Figure 23:
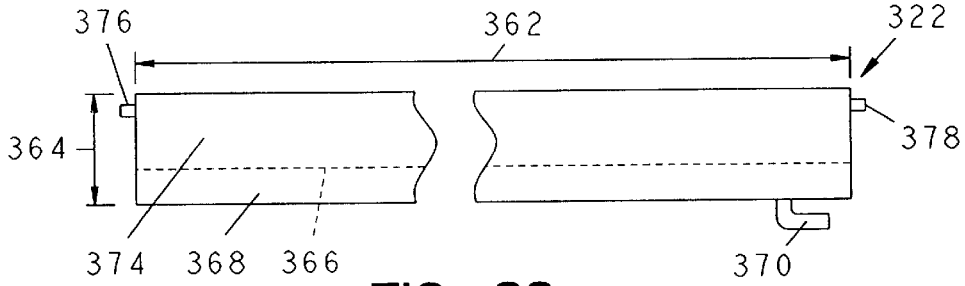
FIG. 23 is a side elevational view of another air bladder embodiment of the present disclosure which includes a single plenum.
Figure 24:
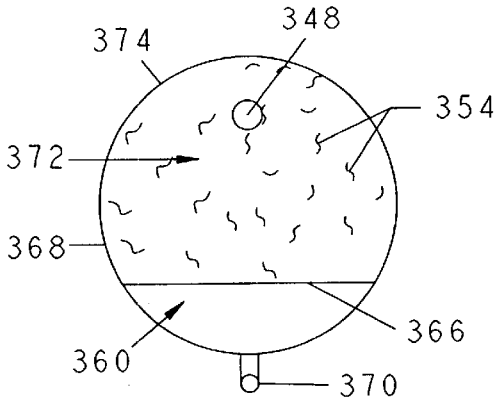
FIG. 24 is a sectional view taken through the air bladder of FIG. 23.

FIGS. 23 and 24 illustrate one of bladders 322 having only a single plenum 360. Bladders 322 have a length 362 of about 30 inches and a diameter 364 of about three inches. A diffuser sheet or diffuser 366 of a diffuser apparatus having a width of about 3 inches is coupled to outer wall 368 along opposite sides. An inlet 370 is coupled to wall 368 in communication with plenum 360. Air supplied through inlet 370 passes into plenum 360 and through diffuser sheet 366 to fluidize fluidizable medium 354 within zone 372. A top portion 374 of bladder 322 is made from air permeable material. Snaps 376, 378 are located at opposite ends of bladder 322 to secure the bladders to a cover. Illustratively, each fluidized zone 356, 372 is loaded with about ten pounds of microspheres and sealed.

Figure 25:
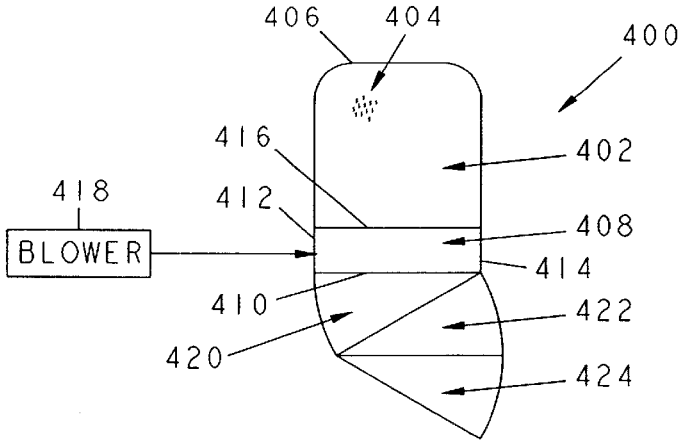
FIG. 25 is a diagrammatical view illustrating another air fluidized support of the disclosure which includes a plurality of inflatable bladders for adjusting the angle of a plenum in order to keep the plenum and the air fluidized zone in a substantially horizontal orientation during articulation of a deck section of a bed.
Figure 26:
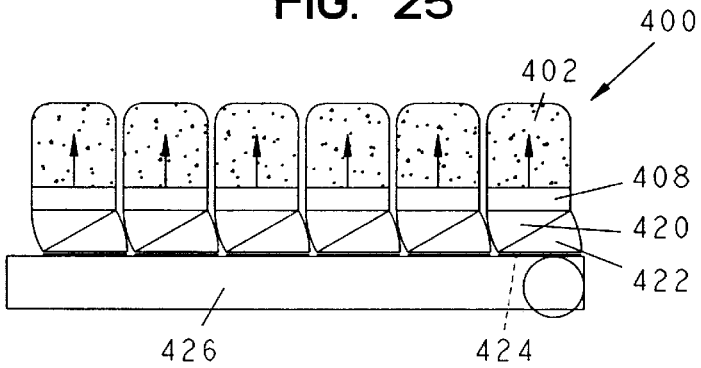
FIG. 26 is a diagrammatical view illustrating a plurality of the air fluidized support bladders of FIG. 25 arranged on a deck section of a bed when the deck section is in a generally horizontal orientation.
Figure 27:
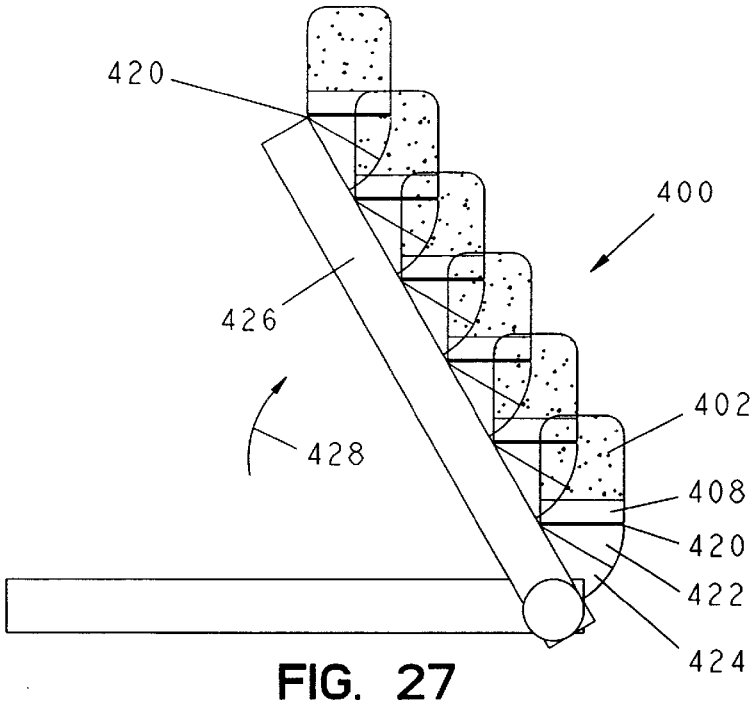
FIG. 27 is a diagrammatical view illustrating the position of the air fluidized supports when the deck section is moved to an inclined position.

Another embodiment of the present disclosure is illustrated in FIGS. 25–27. In this embodiment, a mechanism including inflatable air bladders is used to maintain a plenum and a fluidized bead zone generally parallel to the ground during articulation of a head section of the bed. FIG. 25 is a diagrammatical view illustrating the bladder configuration of this embodiment. Patient support 400 includes a first zone 402 configured to receive beads 404. At least a top surface 406 of the outer wall defining zone 402 is air permeable. Surface 406 is impermeable to beads 404. A plenum 408 is located adjacent zone 402. Plenum 408 is formed by a bottom wall 410 and side walls 412, 414 of the outer wall which are impermeable to air. A top diffuser sheet or diffuser 416 of a diffuser apparatus is air permeable, but impermeable to beads 404. Air is supplied to plenum 408 from a blower 418. Support 400 also includes a mechanism including three triangular shaped zones or bladders 420, 422, 424. Each of bladders 420, 422, 424 is separately connected to an air supply so that zones 420, 422, 424 are independently inflatable and deflatable.

As shown in FIG. 26, a plurality of supports 400 are configured to be located on a deck 426. When in the flat position shown in FIG. 26, bladder 424 is deflated so that plenum 408 is in a generally horizontal position parallel to the ground. As deck 426 is moved in the direction of arrow 428 in FIG. 27 to an inclined position, zone 424 is inflated and zone 420 is deflated so that plenum 408 remains in a substantial horizontal orientation. Therefore, air flow through diffuser sheet 416 maintains fluidization of fluidizable medium 404 within zone 402 during articulation of head section 426.

Figure 28:
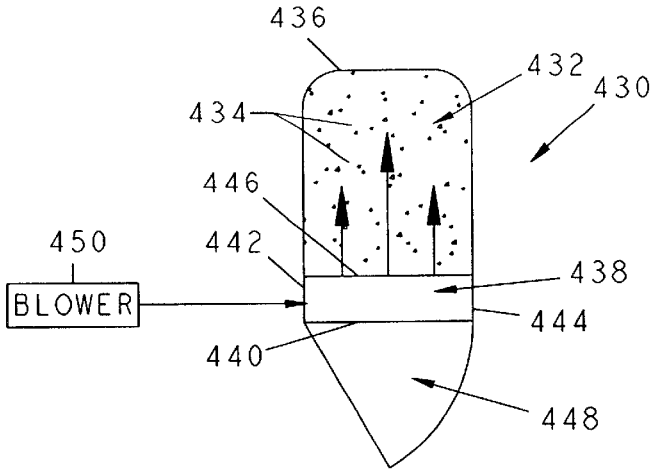
FIG. 28 illustrates another embodiment of an air fluidized support of the present disclosure which includes an air fluidized zone, a plenum, and an inflatable bladder to adjust the position of the air fluidized zone and plenum relative to a deck section of the bed.
Figure 29:
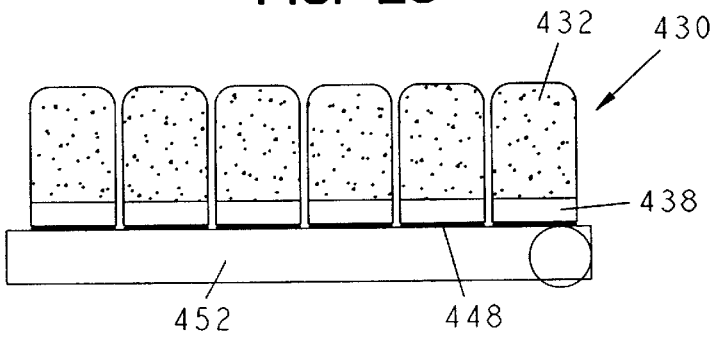
FIG. 29 illustrates the air fluidized support of FIG. 28 located on the generally horizontal deck section.
Figure 30:
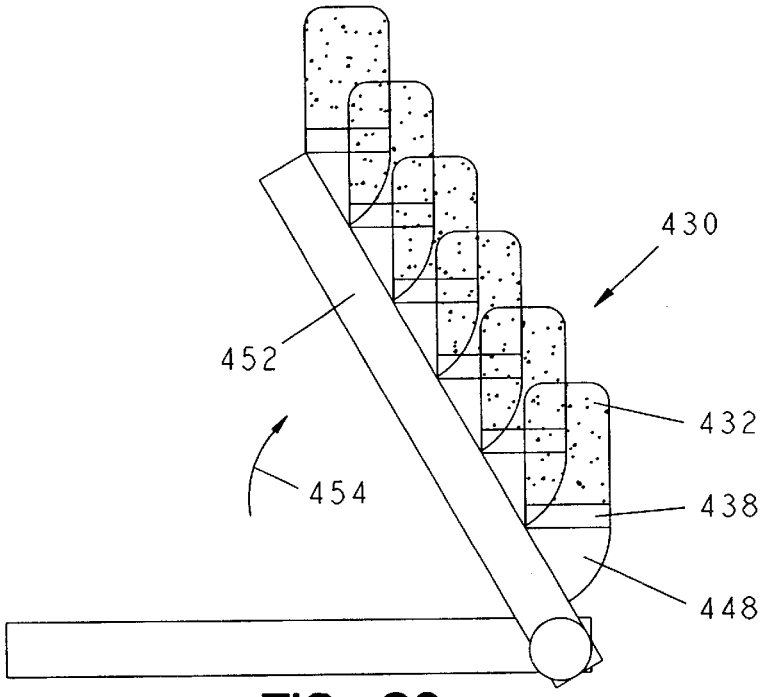
FIG. 30 illustrates the orientation of the supports of FIG. 28 when the deck section is moved to an inclined position.

FIGS. 28–30 illustrate another embodiment of the present disclosure. A support 430 includes a fluidizable zone 432 containing fluidized material 434. At least a top surface 436 of the outer wall which defines fluidized zone 432 is made from an air permeable material. Surface 436 is impermeable to fluidizable material 434. A plenum 438 is located below zone 432. Plenum 438 is formed by a bottom sheet 440 and side walls 442, 444 of the outer wall which are impermeable to air. A diffuser sheet or diffuser 446 of a diffuser apparatus is air permeable. Sheet 446 is impermeable to fluidized medium 434. Therefore, air flows upwardly from diffuser sheet 446 to fluidize material 434 within fluidized zone 432.

A mechanism including a triangular shaped zone or bladder 448 is located below plenum 438. An air supply (not shown) is coupled to bladder 448 for selectively inflating and deflating bladder 448. Plenum 438 is coupled to blower 450. A plurality of supports 430 are configured to be located on a deck 452 of the bed. When deck 452 is in a horizontal orientation shown in FIG. 29, bladder 448 is deflated so that plenum 438 is in a generally horizontal orientation parallel to the ground. When deck section 452 is moved in the direction of arrow 454 in FIG. 30 to the inclined position, zone 448 is inflated to maintain plenum 438 in a substantially horizontal orientation. An angle sensor (not shown) is illustratively coupled to a controller to inflate zone 448 as deck section 452 is inclined to maintain plenum 438 in a substantially horizontal orientation which maintains proper fluidization within zones 432.

Figure 31:
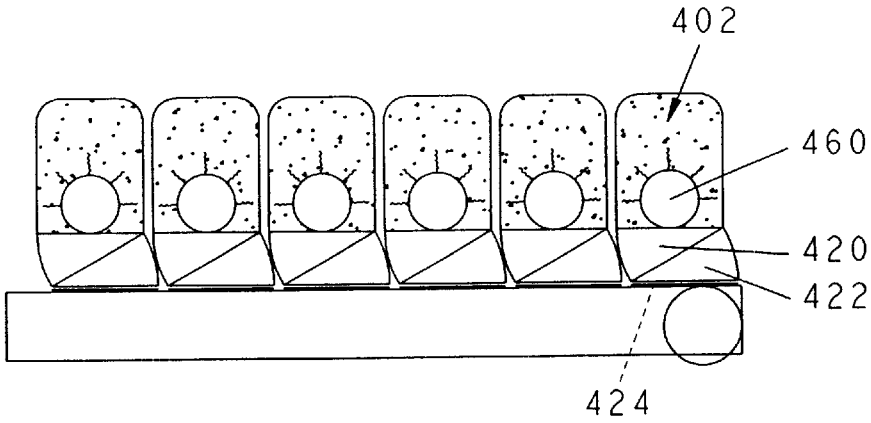
FIG. 31 illustrates yet another embodiment of the present disclosure on a horizontal deck section.
Figure 32:
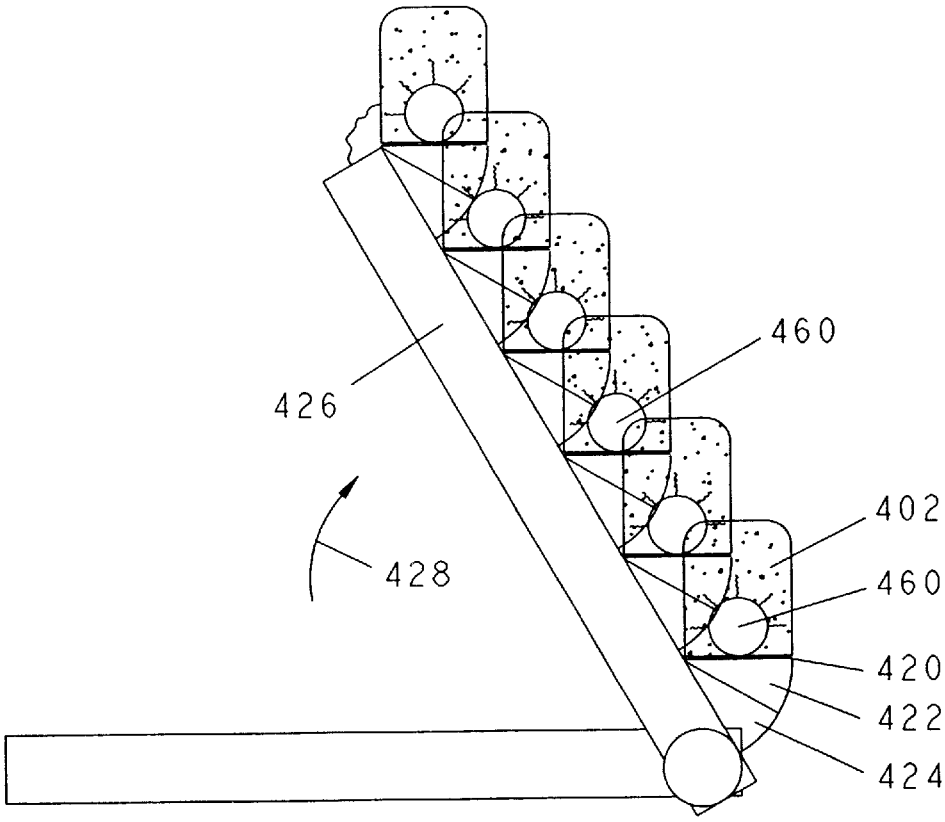
FIG. 32 illustrates the support bladders of FIG. 31 when the deck section is inclined.

Another embodiment of the present disclosure is illustrated in FIGS. 31 and 32. The embodiment of FIGS. 31 and 32 is similar to the embodiment of FIGS. 25–27. Those elements referenced by numbers identical to FIGS. 25–27 perform the same or similar function. In the embodiment of FIGS. 31 and 32, diffuser sheet 416 is replaced with an elongated tube or diffuser 460 of a diffuser apparatus within each fluidized zone 432. Tubes 460 are made from an air permeable material. Tubes 460 are impermeable to fluidized medium 434. Air is supplied to tubes 460 from a blower. When the supports are located on a horizontal deck section 426, zone 424 is deflated. As deck section 426 moves to an inclined or elevated position in the direction of arrow 428 in FIG. 32, zone 424 is inflated and zone 420 is deflated. This maintains the generally horizontal orientation of fluidized zones 432 during articulation of frame 426 to maintain proper fluidization.

Figure 33:
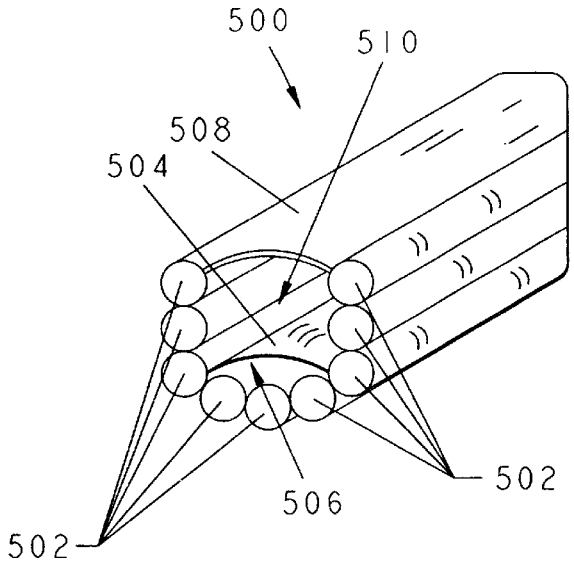
FIG. 33 is a sectional view taken through yet another air fluidized support of the present disclosure including a plurality of air tubes surrounding an air fluidized zone.
Figure 34:
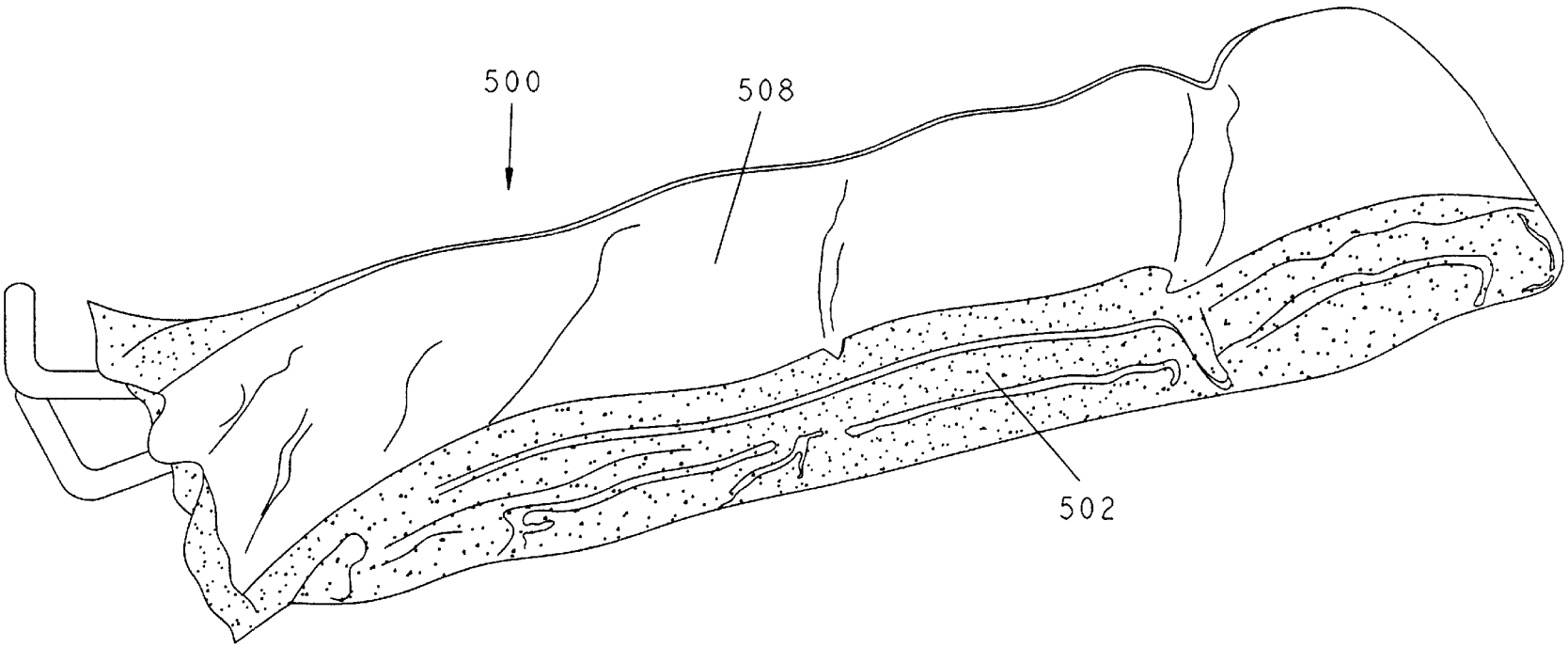
FIGS. 34 and 35 are perspective views of the air fluidized support of FIG. 33.

Another air fluidized bladder is illustrated in FIGS. 33 and 34. As shown in FIG. 33, the bladder includes a plurality of sealed outer air bladders 502 which illustratively communicate with each other pneumatically. A diffuser sheet or diffuser 504 of a diffuser apparatus made of an air permeable material is coupled to an interior wall defined by tubes 502 to form a plenum 506. A filter sheet 508 is coupled along a top portion of bladders 502 of support 500. Filter sheet 508 and diffuser 504 are both air permeable, but impermeable to fluidizable material located within a fluidized zone 510.

Figure 35:
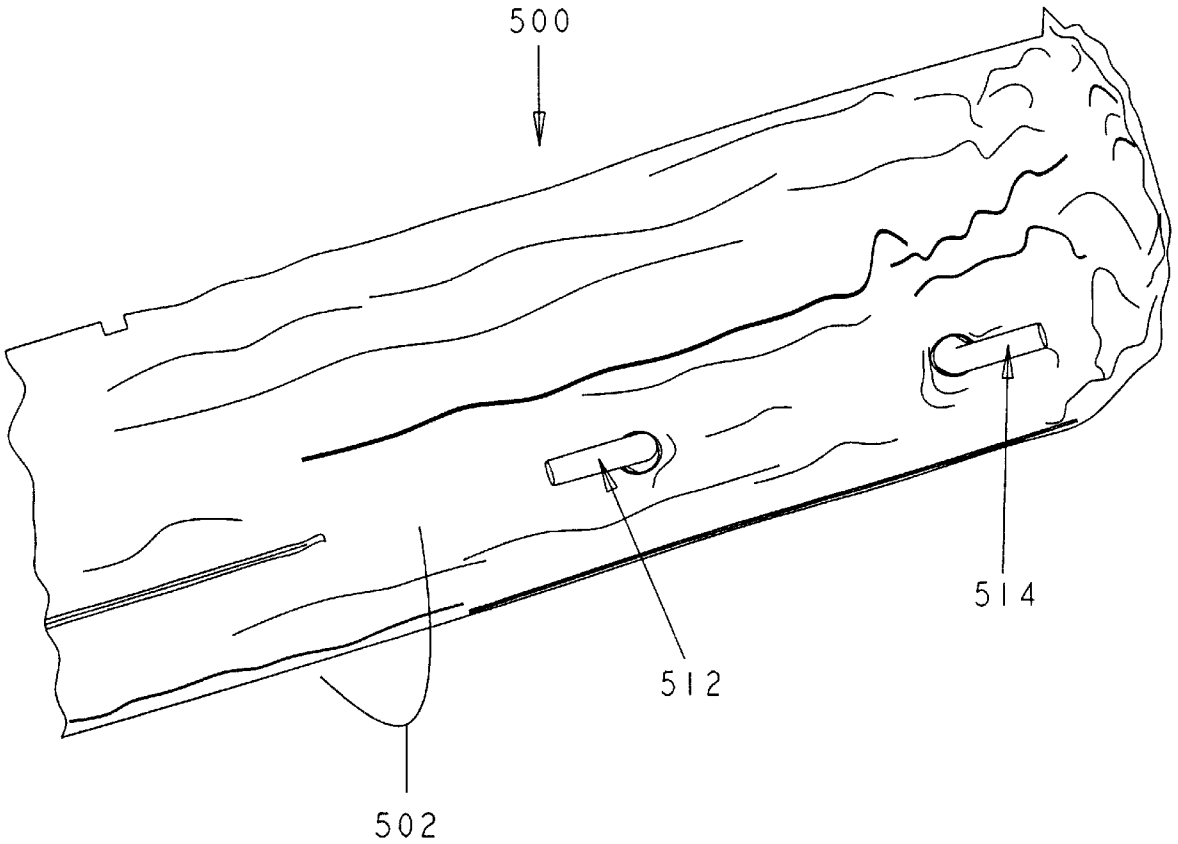

FIGS. 34 and 35 illustrate support 500 in more detail. As shown in FIG. 35, support 500 includes a first air inlet 512 which supplies air to outer air bladders 502 and a second air inlet 514 which supplies air to plenum 506 from a blower.

Figure 36:
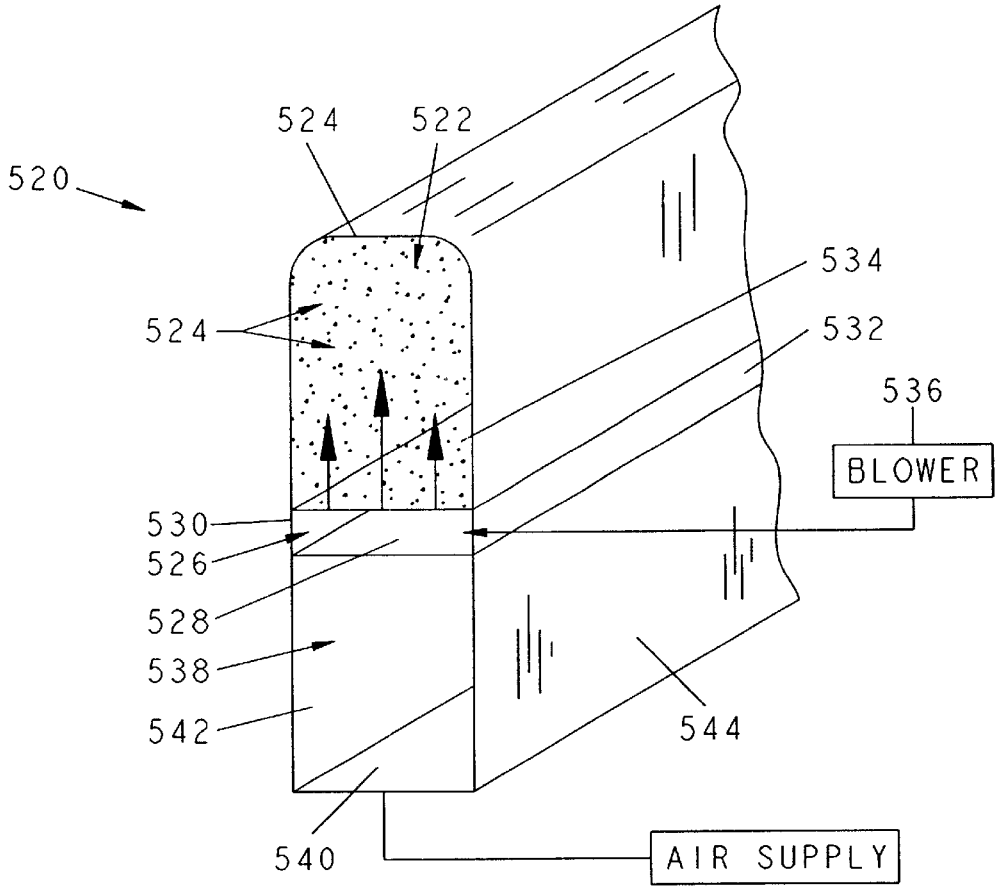
FIG. 36 is a perspective view of yet another embodiment of the present disclosure illustrating an air fluidized support having a fluidized zone, a plenum, and a static air bladder located below the plenum to provide additional support.

FIG. 36 illustrates another embodiment of an air fluidized support 520. Support 520 includes an air fluidized zone 522 containing fluidizable medium 524. A top surface 526 of the outer wall defining zone 522 is formed from an air permeable material. Top surface 525 is impermeable to fluidized medium 524. A plenum 526 is located below zone 522. Plenum is formed by a bottom sheet 528 and side walls 530, 532 or the outer wall which are impermeable to air. A diffuser sheet or diffuser 534 of a diffuser apparatus is air permeable. Sheet 534 is impermeable to fluidized medium 524. Air is supplied from a blower 536 to plenum 526 to fluidize material 524 within zone 522. Support 520 also includes a bottom air bladder or zone 538 defined by bottom surface 540 and side walls 542, 544 which are impermeable to air. An air supply is connected to zone 538 in a conventional manner to supply air at a predetermined pressure to zone 538. Therefore, support 520 includes both a lower static air support zone 538 and an upper air fluidized zone 524 within the same support 520.

Figure 37:
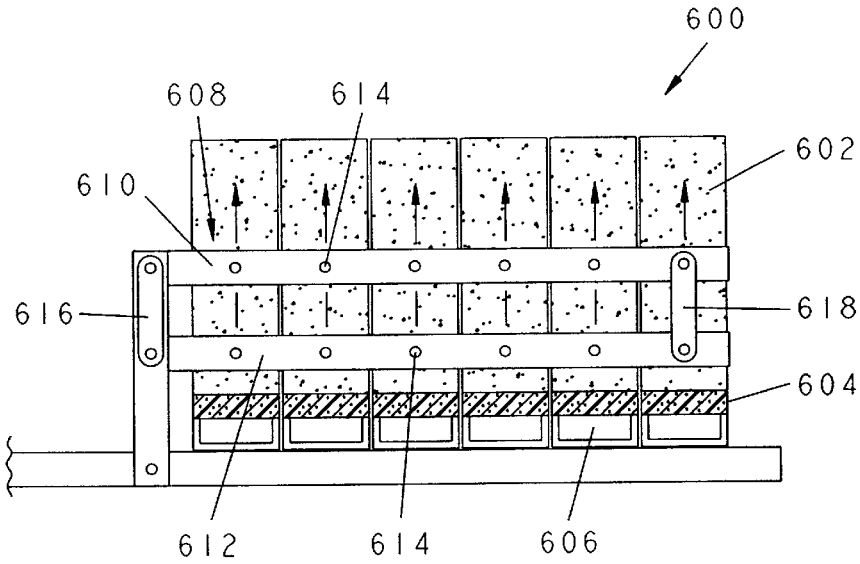
FIGS. 37 and 38 illustrate another embodiment in which adjacent fluidized cells are connected by a parallelogram linkage.
Figure 38:
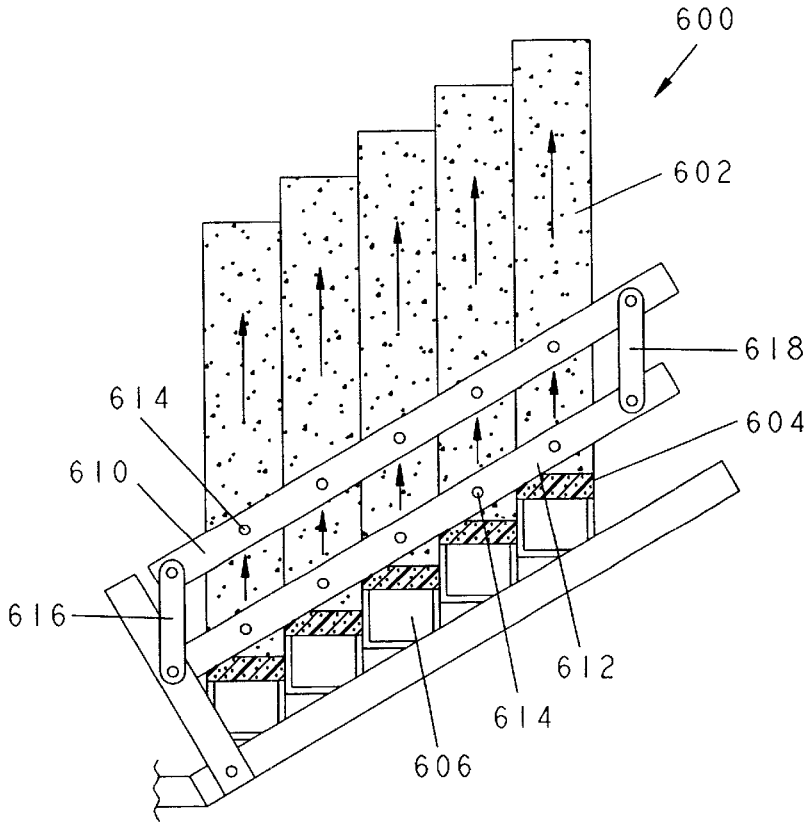

Yet another embodiment of the present disclosure is illustrated in FIGS. 37 and 38. In this embodiment, separate fluidized cells 600 each include an upper fluidized zone 602, a diffuser sheet or diffuser 604 of a diffuser apparatus, and an air plenum 606 located below diffuser sheet 604. Each air plenum 606 is coupled to a blower. A parallelogram linkage mechanism 608 includes upper and lower arms 610, 612 which are rotatably coupled to each of cells 600 by fasteners 614. End sections 616, 618 are pivotably coupled to upper and lower arms 610, 612. Parallelogram linkage 608 is coupled to an articulating deck so that when the deck section is moved to an inclined orientation, the parallelogram linkage moves cells 600 to the orientation shown in FIG. 38, for example, so that each of plenums 606 and diffuser sheets 604 remain substantially horizontal or parallel to the ground to permit continued fluidization when in an inclined orientation.

Figure 39:
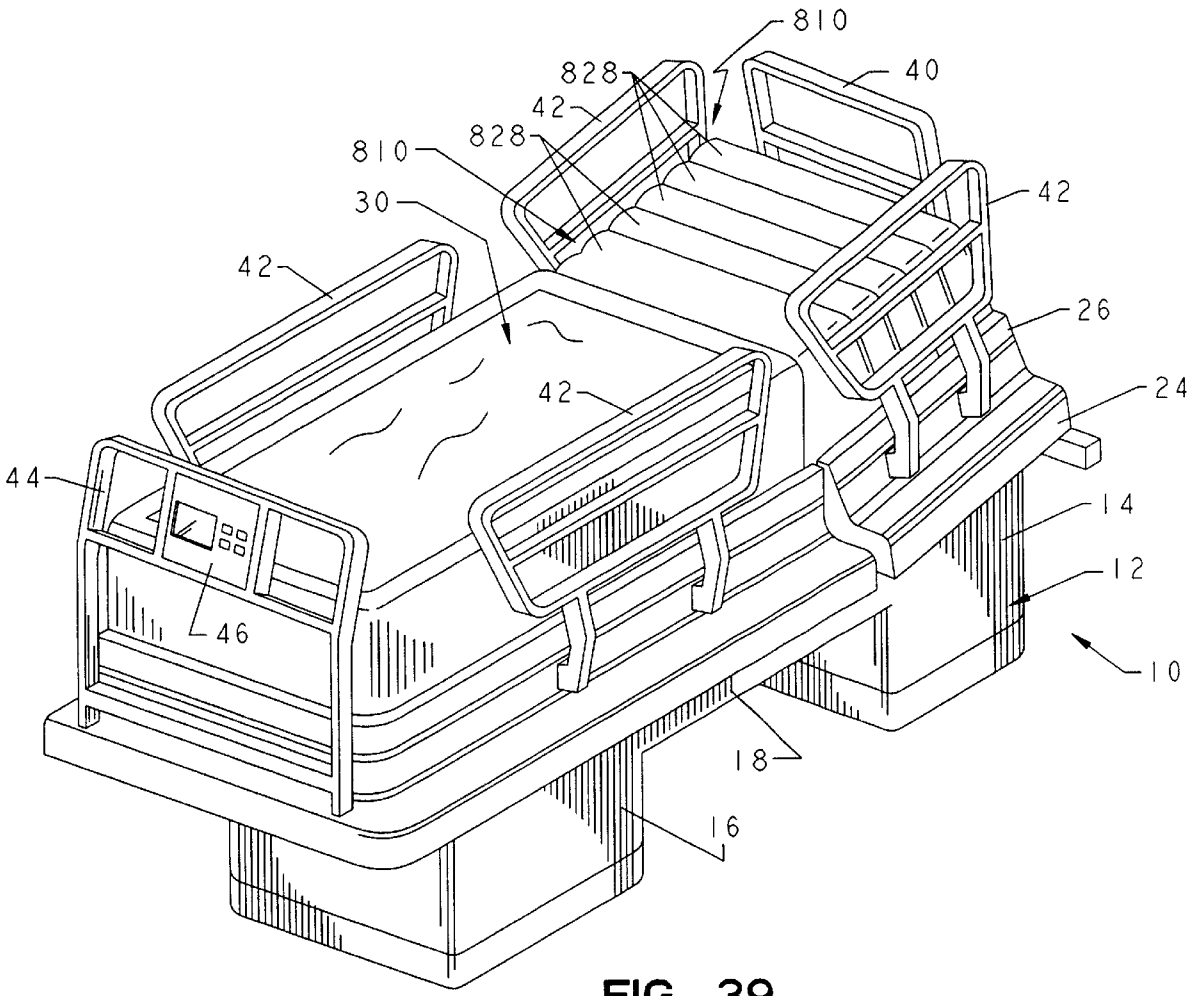
FIG. 39 is a perspective view of a hospital bed of the present disclosure including a plurality of fluidized bladder units located on an articulating head section of the bed and a larger fluidized region located below the feet, legs, and seat of the patient.
Figure 40:
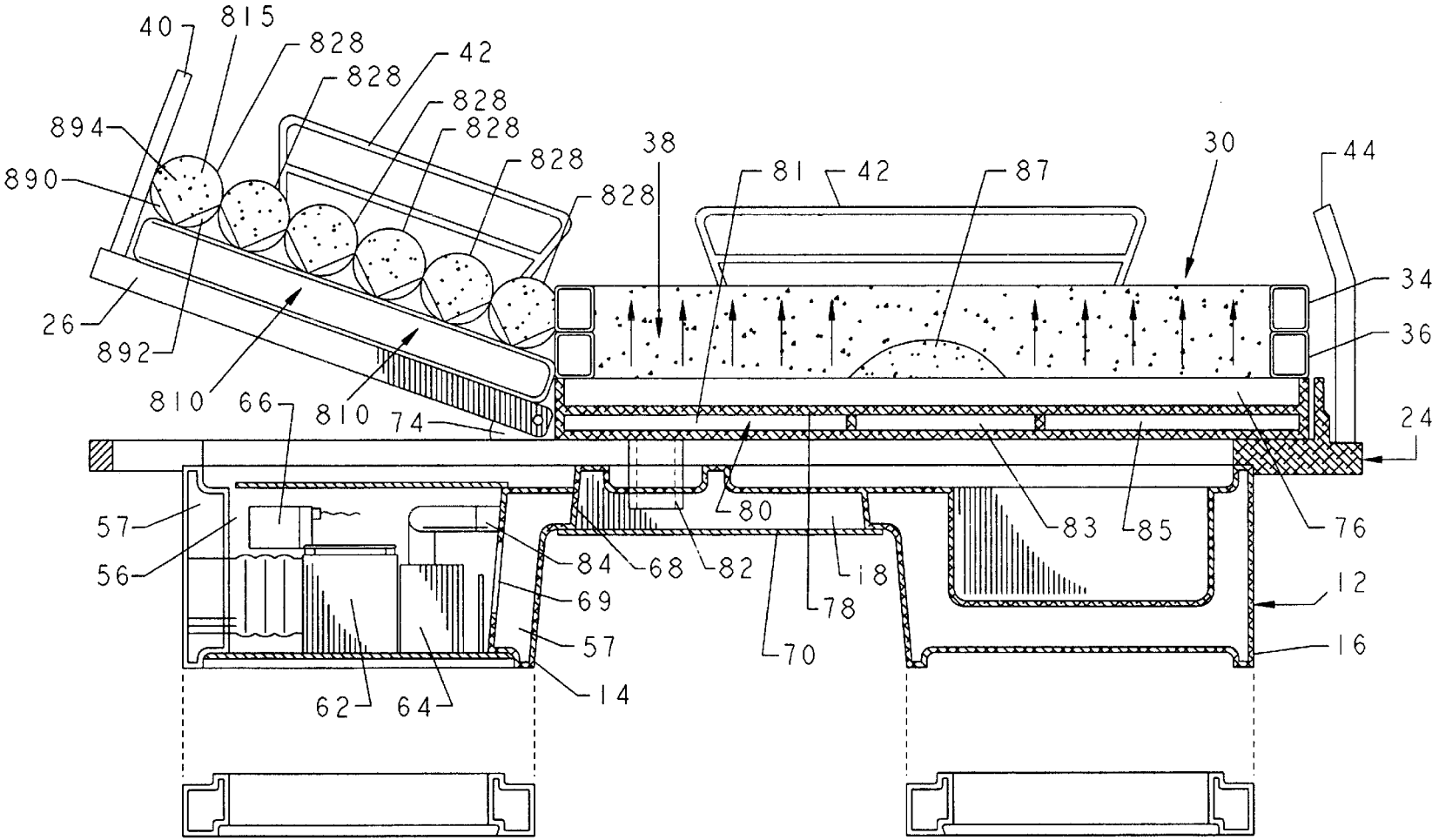
FIG. 40 is a sectional view taken through the bed of FIG. 39 showing details of the fluidized bladder units including a plurality of circular fluidized bladders located on the head section of the bed and details of the air fluidized section located below the seat, legs and feet of the patient.

Referring now to FIG. 39, a pair of air fluidized bladder units 810 having three air fluidized bladders 828 are located on head section 26. Air fluidized bladder units 810 are capable of maintaining air fluidization within bladders 828 as head section 26 is articulated. To accomplish this continuous air fluidization, each of bladders 828 includes a first plenum 890 and a second plenum 892. A third fluidized zone 894 contains fluidizable medium 815.

Figure 43:
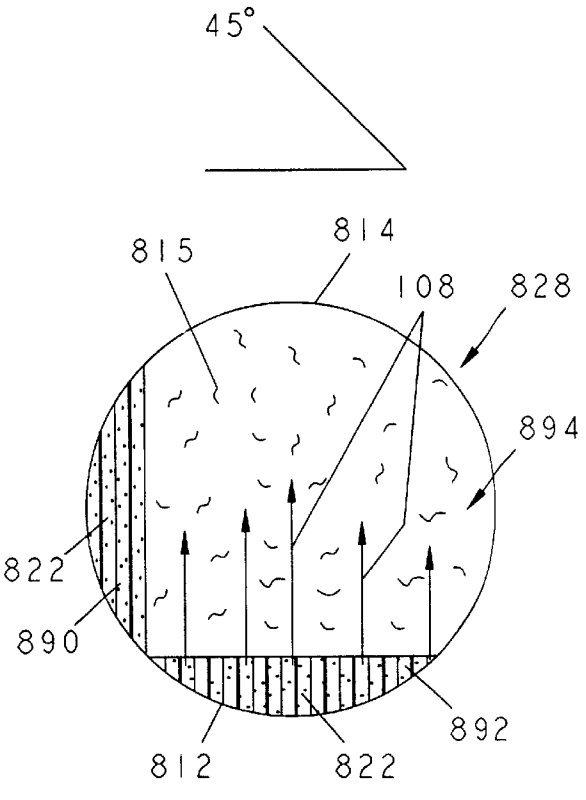
FIGS. 41–43 are diagrammatical views illustrating the orientation of one of the fluidized bladders of the fluidized bladder units located on the head section which include first and second plenums and an air fluidized zone when the head section is positioned at a −45° angle as shown in FIG. 41, a 0° angle as shown in FIG. 42, and a 45° angle as shown in FIG. 43.
Figure 42:
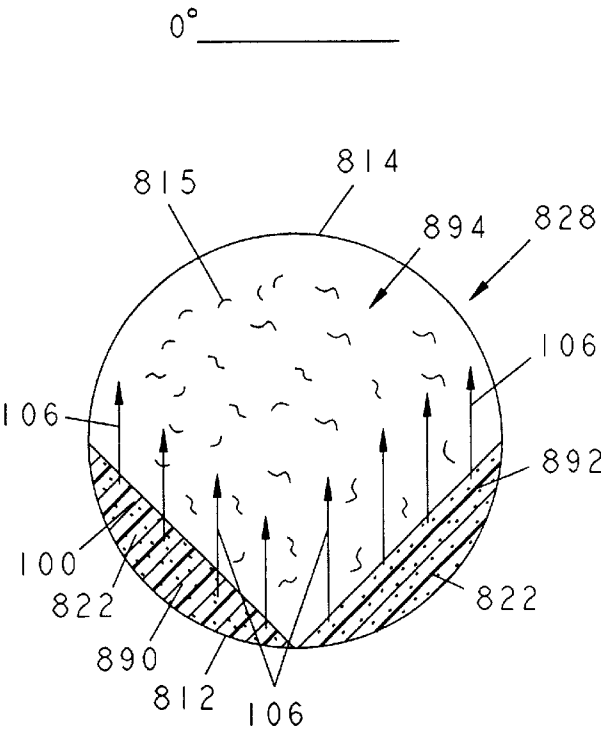
Figure 44:
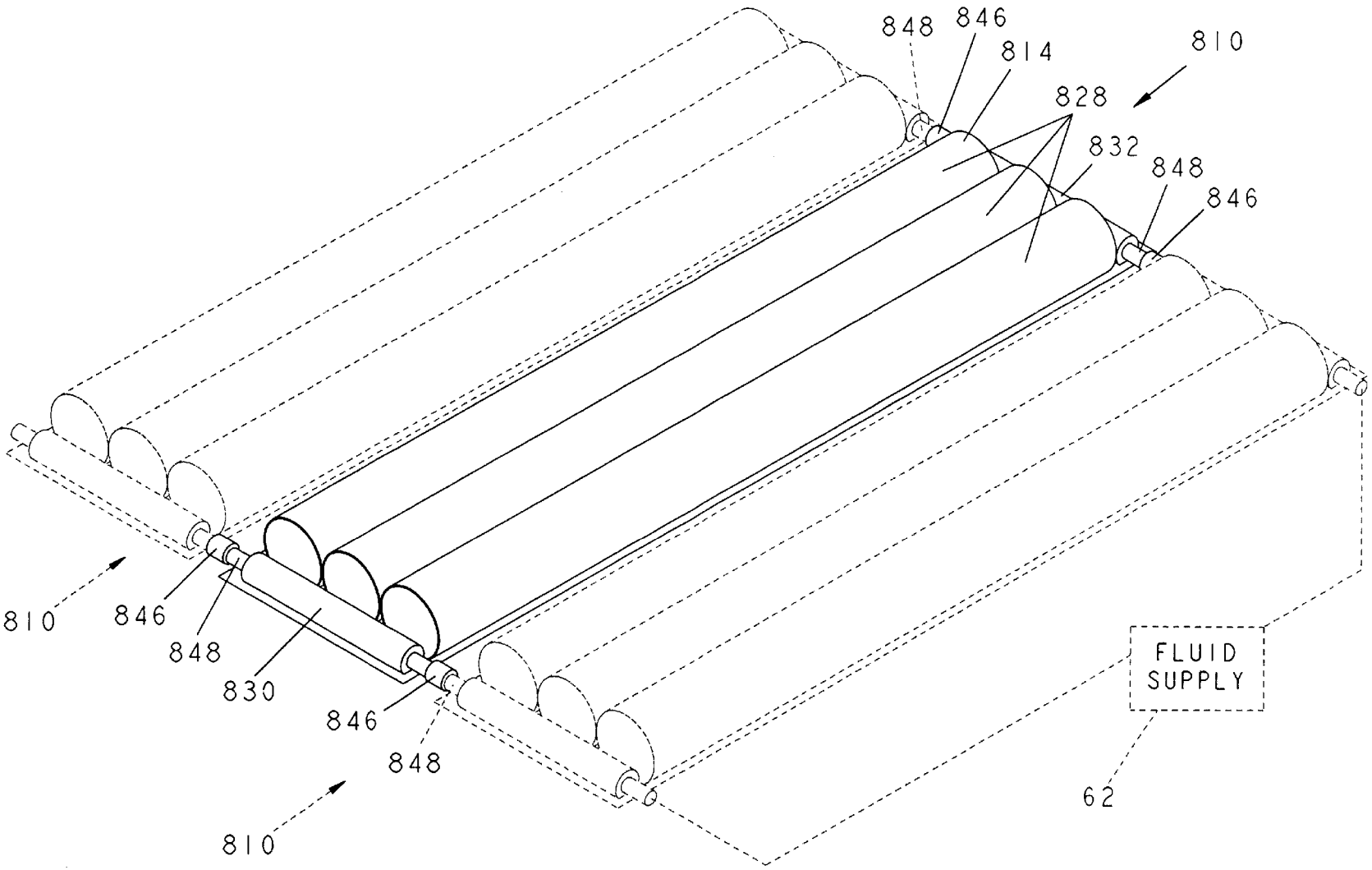
FIG. 44 is a perspective view of three preferred embodiment air fluidized bladder units (two shown in phantom lines and one shown in solid lines) showing each unit including three fluidized bladders.

Bladder units 810 include an outer wall having a bottom air impermeable outer sheet 812, as shown in FIGS. 41–43 and 50, and an upper air permeable outer sheet 814. Plenums 890, 892 are formed by alternating diffusers 816, 818 of an air permeable and fluidizable medium impermeable diffuser sheet or diffuser apparatus 820 coupled to impermeable outer sheet 812. First and second air manifolds 830, 832 are provided, as shown in FIG. 44, that are coupled to blower 62. First manifold 830 provides pressurized air to first plenums 890 and second manifold 832 provides pressurized air to second plenums 892. Open cell foam portions 822 are positioned in first and second plenums 890, 892 between each diffuser 816, 818 of diffuser sheet 820 and outer sheet 812. According to alternative embodiments of the present disclosure, a perforated plastic tube is provided in the first and second plenums.

In the embodiment of FIGS. 41–43 and 50, first and second diffusers 816, 818 are aligned at about a 90° angle as shown by angle 691 to define a V-shaped concave diffuser surface. When head section 26 is in a generally horizontal flat position, air is supplied to both first and second manifolds 830, 832 and first and second plenums 890, 892 so that air flows upwardly in the direction of arrows 106 in FIG. 42 to fluidize fluidizable medium 815 within zone 894 and provide support for the patient.

As head section 26 is inclined, air flow is gradually shifted from first manifold 830 to second manifold 832 so that less air is provided to first plenum 890 and more air is provided to second plenum 892. When head section 26 is aligned at an angle of about 45°, air flow from the blower is supplied only to second manifold 832 and second plenum 892 so that air flows in the direction of arrows 108 shown in FIG. 43 upwardly through fluidizable medium 815 in zone 894.

Figure 41:
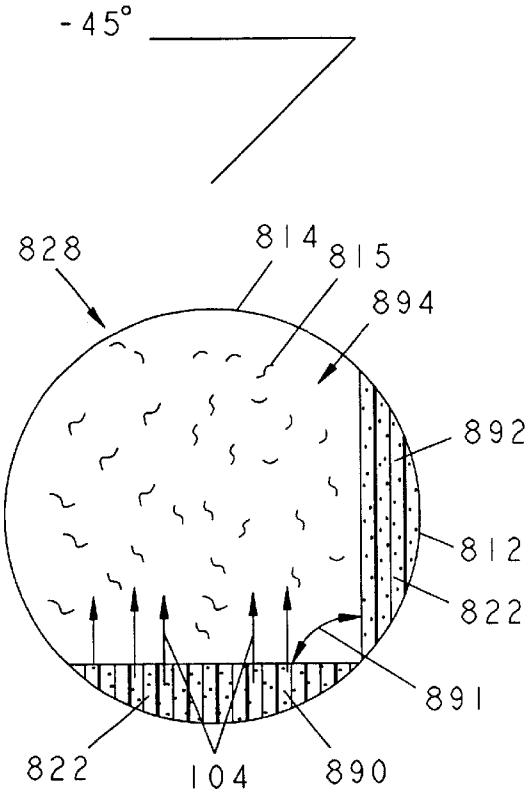

As shown in FIG. 41, diffuser 816 directs air in multiple parallel flow directions into fluidization zone 894. Similarly, diffuser 818 directs air in multiple parallel flow directions into fluidization zone 94 as shown in FIG. 43. When pressurized air is supplied to both diffusers 816, 818, the multiple parallel flow directions created by diffuser 816 intersect the multiple flow direction created by diffuser 818 at multiple points in fluidization zone 894. Thus, multiple points exists in fluidization zone 894 through which at least two flow directions meet. At least one of these points is located at the center of fluidization zone 894. A plurality of these points are located at a center portion of fluidization zone 894. Furthermore, a plurality of these points are located adjacent to sheet 814. Thus, air from two sources is initially directed at most points in fluidization zone 894 to assist fluidization of the fluidizable medium when both diffusers 816, 818 are provided with pressurized air.

If head section 26 is lowered, air flow is gradually shifted from second manifold 832 to first manifold 830. When head section 26 is aligned at an angle about −45°, air flow from blower 62 is supplied only to first manifold 830 and first plenums 890 so that air flows in the direction of arrows 108 shown in FIG. 41 upwards through fluidized medium 815 in zone 894.

It is understood that first and second plenums 890, 892 can be aligned at any suitable angles. In addition, more than two plenums may be used inside bladders 28, if desired. According to alternative embodiments, air is continuously provided to both the first and second plenums when the head section of the bed is inclined or lowered.

The air fluidized bladder embodiments discussed above with reference to FIGS. 39–43 maintain fluidization within each bladder when the bladder is aligned at different angles by positioning diffuser material sheets at angular different locations within the bladder. By positioning two diffusers 816, 818 of diffuser sheet 820 at a 90° angle as shown in FIGS. 40–43 and 50, 90° of rotation can be achieved for bladders 828.

In another embodiment of the present disclosure, diffusers 816, 818 of diffuser sheet 820 are aligned at a 120° angle. This embodiment permits fluidization through rotation of a head section to about 60°. In this embodiment, air is supplied to the first plenum at 100% when the angle is at 30°. At 0° inclination, air is illustratively supplied at 50% to the first plenum and 50% to the second plenum. Finally, at 30°, air is supplied at 100% to the second plenum.

Figure 45:
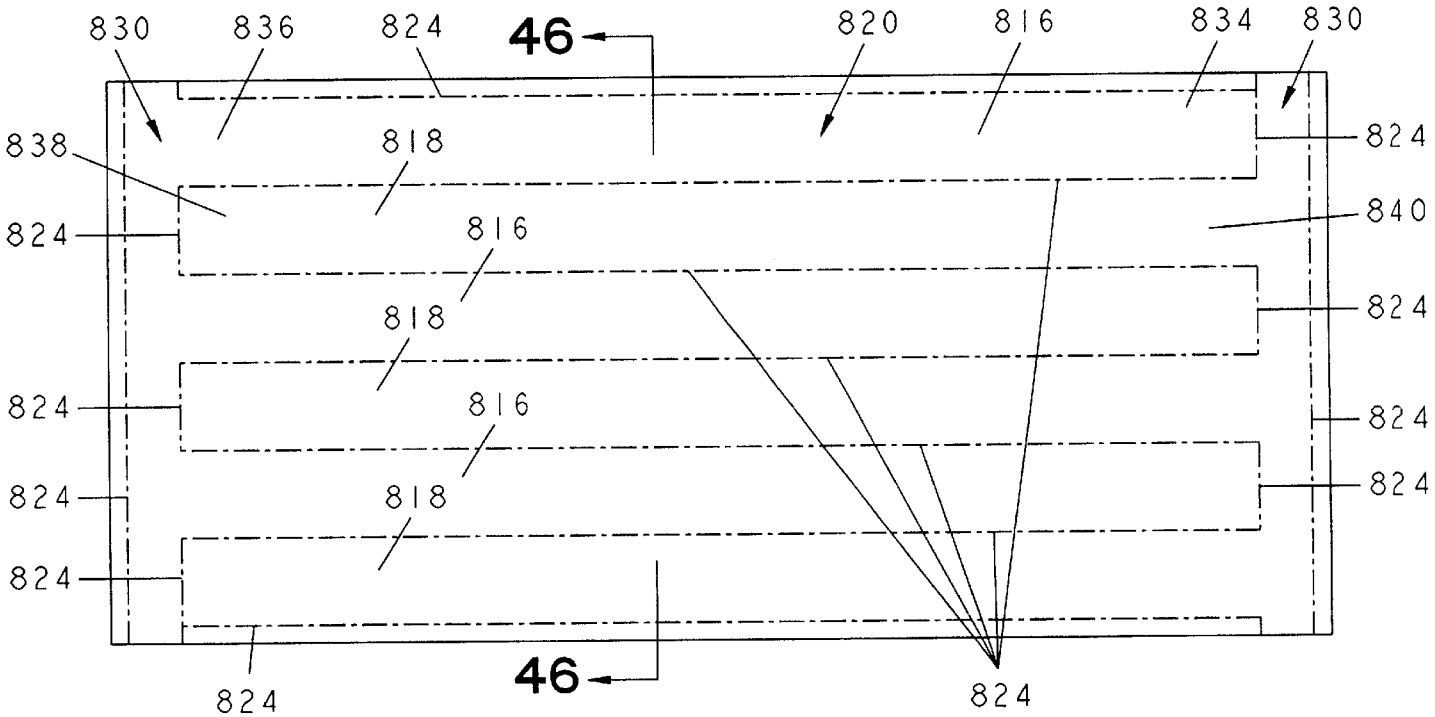
FIG. 45 is a top plan view of a partially assembled fluidized bladder unit showing a first set of seal lines (shown in dashed lines) formed thereon to define six transversely extending parallel air plenums and two longitudinally extending manifolds.
Figure 46:
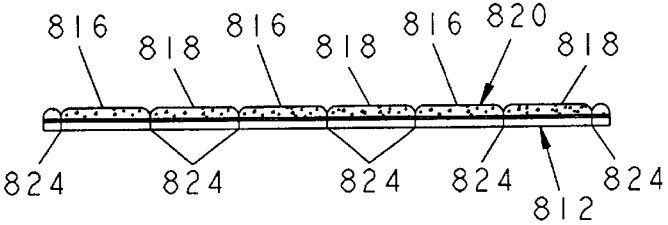
FIG. 46 is a sectional view taken along line 46—46 of FIG. 45 showing a first layer of air permeable material positioned over a second layer of air impermeable material and the first set of seal lines coupling the first and second layers together to define the six air plenums.
Figure 47:
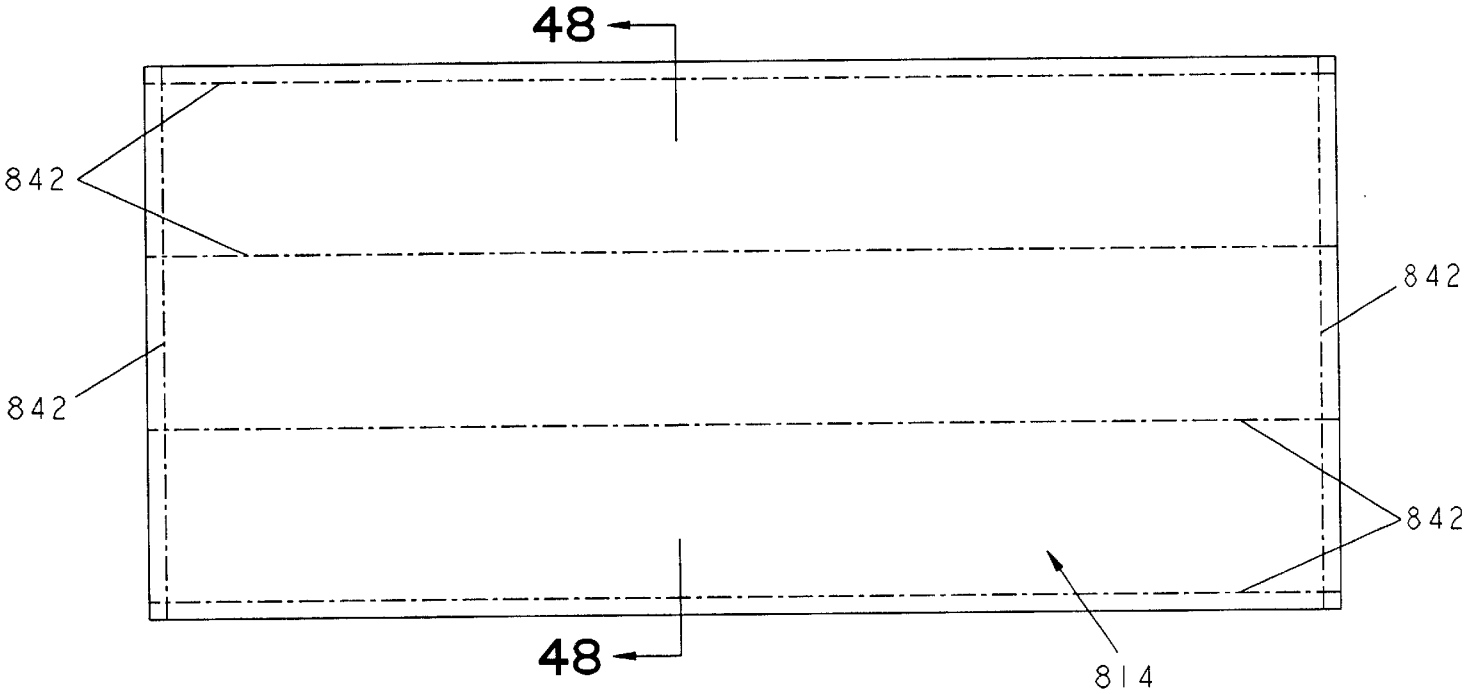
FIG. 47 is a top plan view of the partially assembled fluidized air bladder unit of FIG. 45 showing a third layer of air permeable material positioned thereon and a second set of seal lines (shown in dashed lines) formed thereon to define the three transversely extending fluidized bladders.
Figure 48:
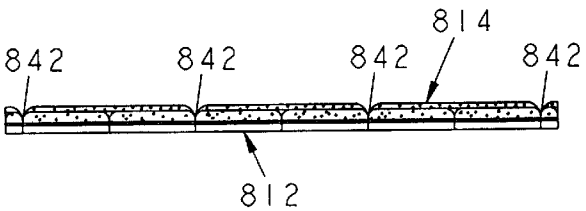
FIG. 48 is a sectional view taken along line 48—48 of FIG. 47 showing the third layer of air permeable material positioned over the first and second layers of material and the second set of seal lines coupling the third layer of air permeable material to the first and second layers to define the three fluidized bladders.
Figure 49:
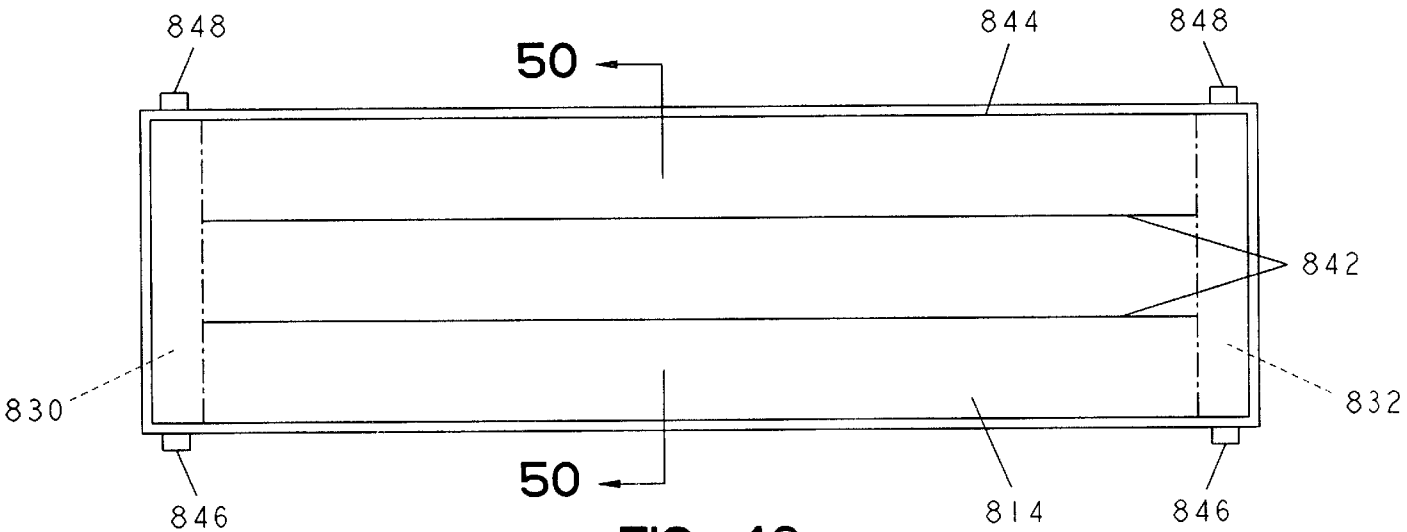
FIG. 49 is a top plan view of the fluidized bladder unit of FIG. 44 showing the unit pressurized with air.
Figure 50:
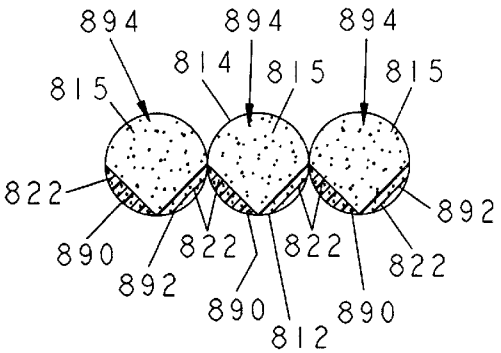
FIG. 50 is a sectional view taken along line 50—50 of FIG. 49 showing foam portions positioned between the first and second layers of material and the three fluidized bladders pressurized to assume a circular shape.

According to a present disclosure, a preferred method of assembling fluidized air bladder units 810 is also provided. Initially, medium impermeable sheet 820 is positioned over bottom air impermeable sheet 812 and a first set of seal lines 824 are formed thereon to couple sheets 812, 820 together as shown in FIGS. 45 and 46. Seal lines 824 separate alternating first and second plenums 890, 892 and define first and second manifolds 830, 832 at transverse ends of plenums 890, 892. First plenums 890 have closed ends 834 adjacent to second manifold 832 and open ends 836 adjacent to and in fluid communication with first manifold 830. Similarly, second plenums 892 have closed ends 838 adjacent to first manifold 830 and open ends 840 adjacent to and in fluid communication with second manifold 832. Before seal lines 824 are formed, foam portions 822 are positioned on bottom sheet 812 so that foam portions 822 are positioned in the respective plenums 890, 892 as seal lines 824 are formed. According to the presently preferred disclosure, seal lines 824 are formed by ultrasonic welding or stitching sheets 812, 820 together.

After plenums 890, 892 and manifolds 830, 832 have been formed, upper air permeable sheet 814 is positioned over sheets 812, 820 and a second set of seal lines 342 are formed thereon to couple sheets 812, 814, 820 together. Seal lines 842 define and separate three air bladders 828 and define an outer lip 844 around the 25 perimeter of air bladder unit 820. According to alternative embodiments of the present disclosure, fewer or more bladders are formed in the fluidized bladder units. For example, according to an alternative embodiment of the present disclosure, seven air bladders are provided with four air bladders communicating with the first manifold and three air bladders communicating with the second manifold.

Fluidizable medium 815 is placed between upper air sheet 814 and middle sheet 820. Male and female quick connects 846, 848 are positioned in the inlet and outlets to manifolds 830, 832 so that several air bladder units 810 can be coupled in series as shown in FIG. 44.

Figure 51:
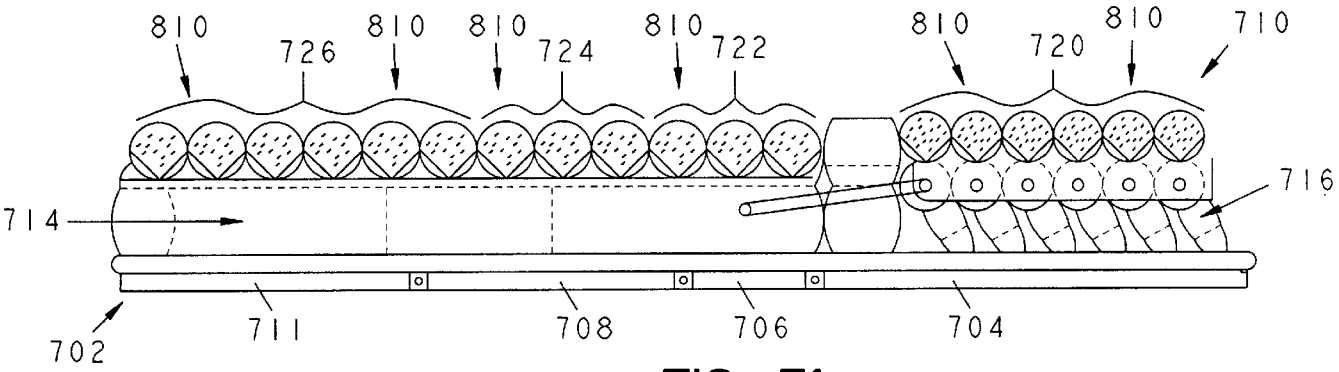
FIG. 51 is a sectional view of another embodiment of the present disclosure illustrating a mattress having a plurality of fluidized bladder units extending transversely across a deck of the bed.
Figure 52:
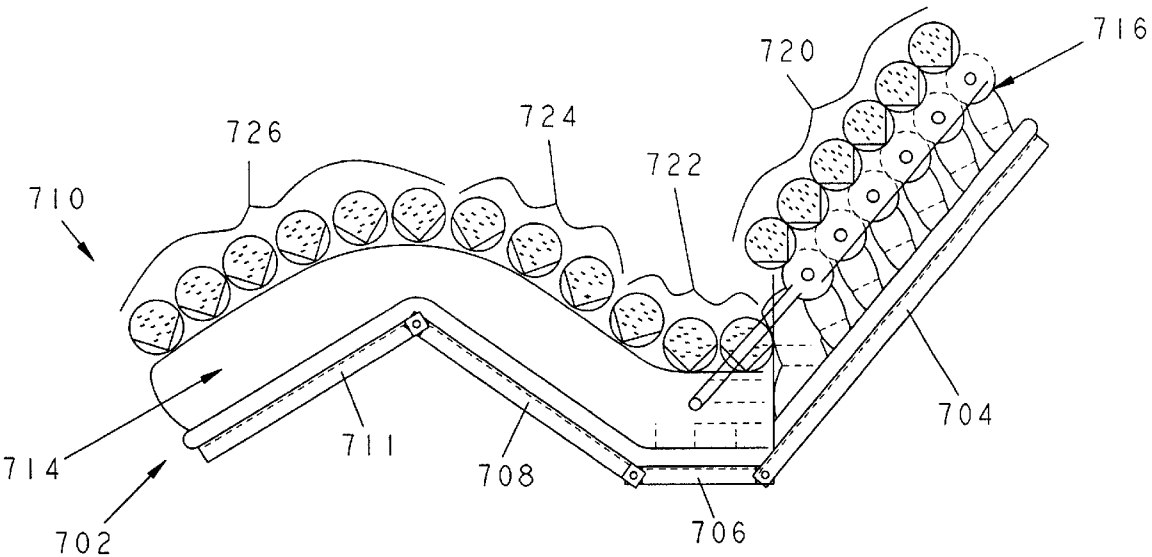
FIG. 52 is a sectional view similar to FIG. 51 in which the head section and knee section of the deck are inclined.

Another embodiment of the present disclosure is illustrated in FIGS. 51 and 52. In this embodiment, a mattress or support surface apparatus 710 is located on a frame or deck 702 having head, seat, thigh, and a foot sections 704, 706, 708, 711. Frame 702 is movable from a flat orientation shown in FIG. 51 to an articulated orientation shown in FIG. 52. Mattress 710 includes a plurality of separate air fluidized bladder units 810 located on a top portion of mattress 710. Suitable support portions 714, 716 are located under air fluidized bladder units 810. Support portions 714, 716 may be air bladders, foam, or other suitable support structures. A base 716 of mattress 710 rests upon frame 702.

Air fluidized bladder units 810 include head, seat, thigh, calf and foot zone bladder units 720, 722, 724, 726. Bladder units 810 in head, seat, thigh, and calf and foot zone bladder units 720, 722, 724, 726 include air bladders and first and second plenums as discussed above. These multiple plenums are used to accommodate movement of bladder units 720, 724, 726 to different inclined positions during articulation of frame 702 as shown in FIG. 52. Depending on the angular position of the deck on which units 720, 722, 724, 726 are positioned, the percentage of air provided to the respective plenums shifts to maintain fluidization in the air bladders. According to an alternative embodiment, both the first and second plenums of the units have air continuously flowing through them when the sections of the deck are inclined and lowered.

Figure 53:
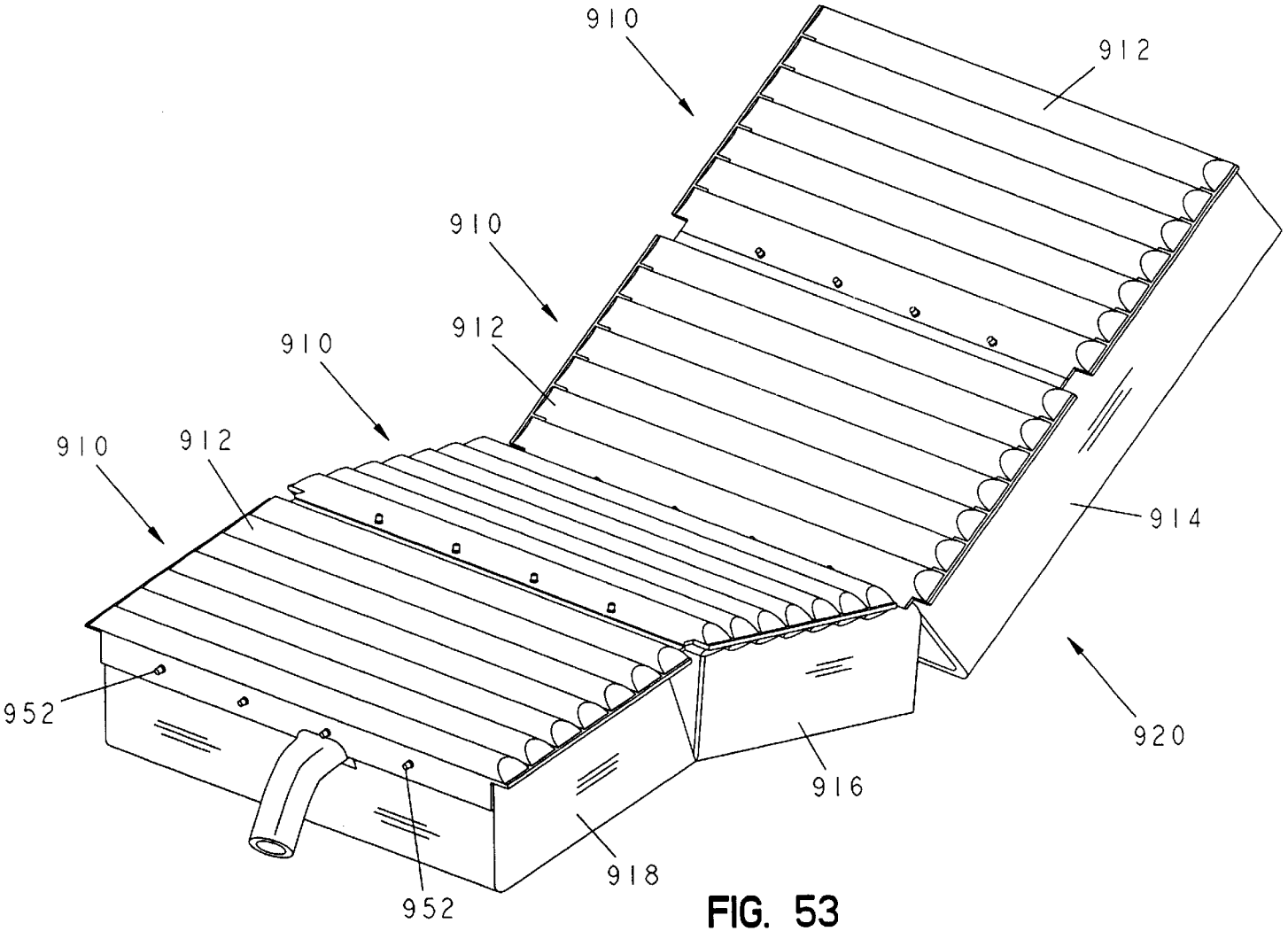
FIG. 53 is a perspective view of a hospital bed of the present disclosure including a plurality of fluidized bladder units located on leg, seat, back, and head sections of the bed.
Figure 54:
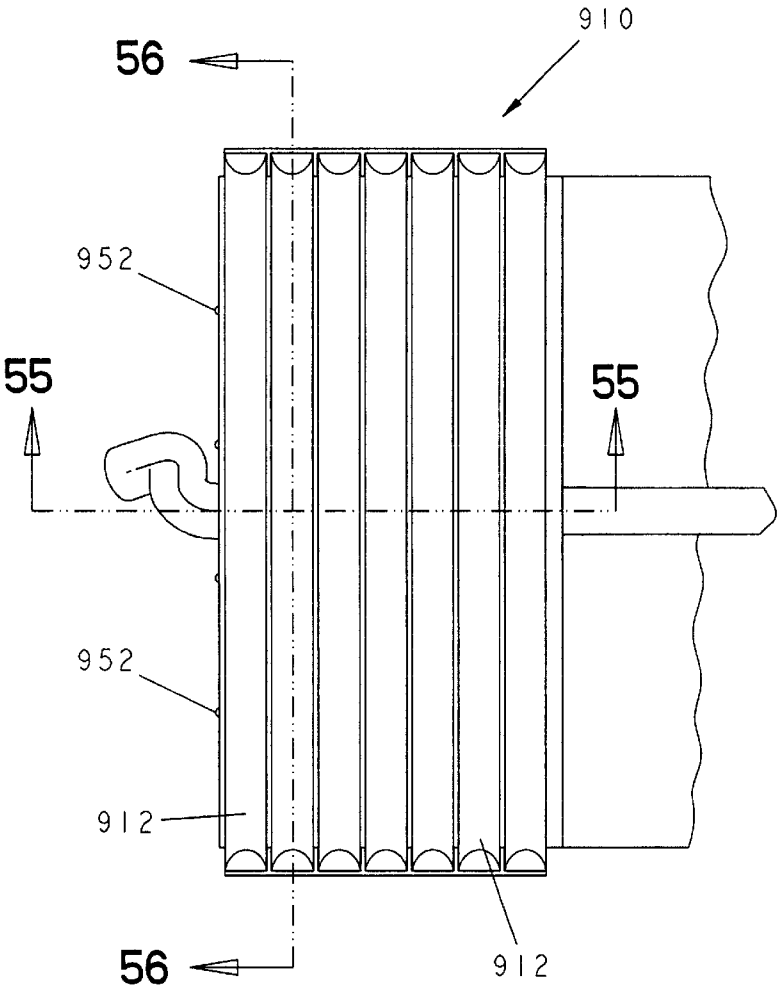
FIG. 54 is a top plan view of the foot section of the bed of FIG. 53.

Referring now to FIG. 53, four air fluidized bladder units 910 having seven air fluidized bladders 912 each are located on head, seat, and leg sections 914, 916, 918 of a deck 920. Air fluidized bladder units 910 are configured to maintain air fluidization within bladders 912 as head and leg sections 914, 918 are articulated. To accomplish this continuous air fluidization, each of bladders 912 includes a first plenum 922 and a second plenum 924. A third fluidized zone 926 contains fluidizable medium 928.

Figure 55:
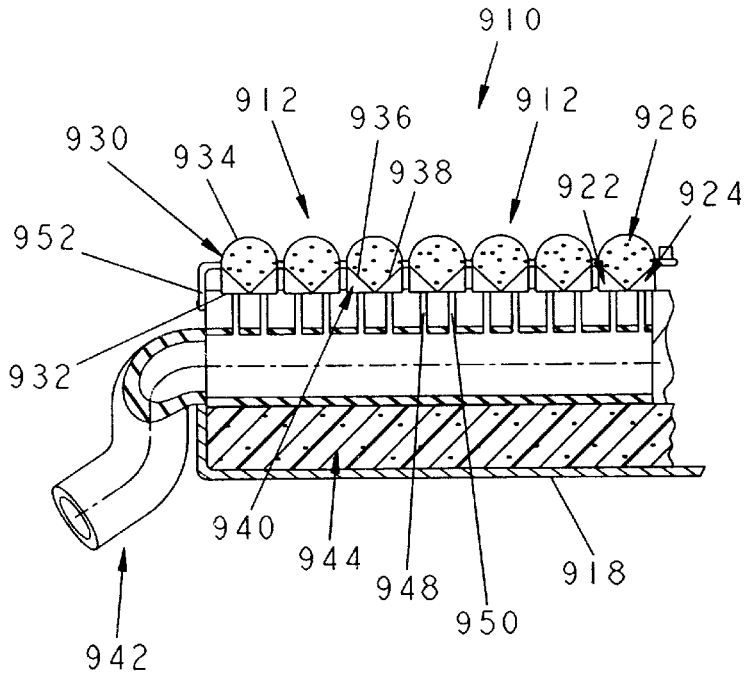
FIG. 55 is a sectional view taken along line 55—55 of FIG. 54 showing the mattress further including a foam section positioned under the fluidized bladder unit and an air manifold positioned in a longitudinally extending channel formed in the foam section.
Figure 56:
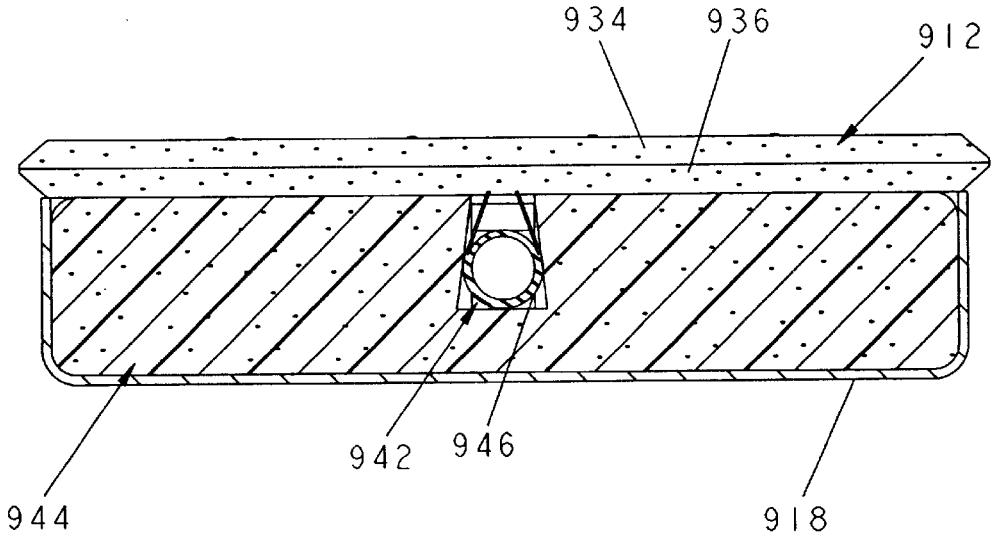
FIG. 56 is a sectional view taken along line 56—56 of FIG. 54 showing the manifold positioned in the channel formed in the foam section.

Bladders 912 include an outer wall 930 having a bottom air impermeable outer sheet 932, as shown in FIG. 55, and an upper air permeable outer sheet 934. Plenums 922, 924 are formed by alternating sections 936, 938 of an air permeable and fluidizable medium impermeable diffuser sheet or diffuser 940 of a diffuser apparatus coupled to impermeable outer sheet 932. An air manifold 942 is provided, as shown in FIGS. 55 and 56, that is coupled to a blower (not shown). Manifold 942 provides pressurized air to first and second plenums 922, 924.

A foam base 944 is provided that is positioned between bladder units 910 and deck 920. Foam base 944 includes a channel or groove 946 sized to receive air manifold 942. A series of passages 948, 950 are provided that communicate air from manifold 942 to first and second plenums 922, 942 as shown in FIG. 55.

In the embodiment of FIGS. 53–57, first and second plenums 922, 924 are aligned at about a 90° angle. Regardless of the position of head, seat, and leg sections 914, 916, 918 of deck 920, manifold 942 provides air to each plenum 922, 942 so that air is provided in at least two directions to the fluidization zone at all times. According to alternative embodiments of the present disclosure, two manifolds are provided and the supply of air is shifted between the plenums in a manner similar to that described above. Because there are two diffusers 936, 938, air is directed from two directions at multiple points within the fluidization zone as described above.

It is understood that first and second plenums 922, 924 can be aligned at any suitable angles. In addition, more than two plenums may be used inside the bladders, if desired.

Figure 57:
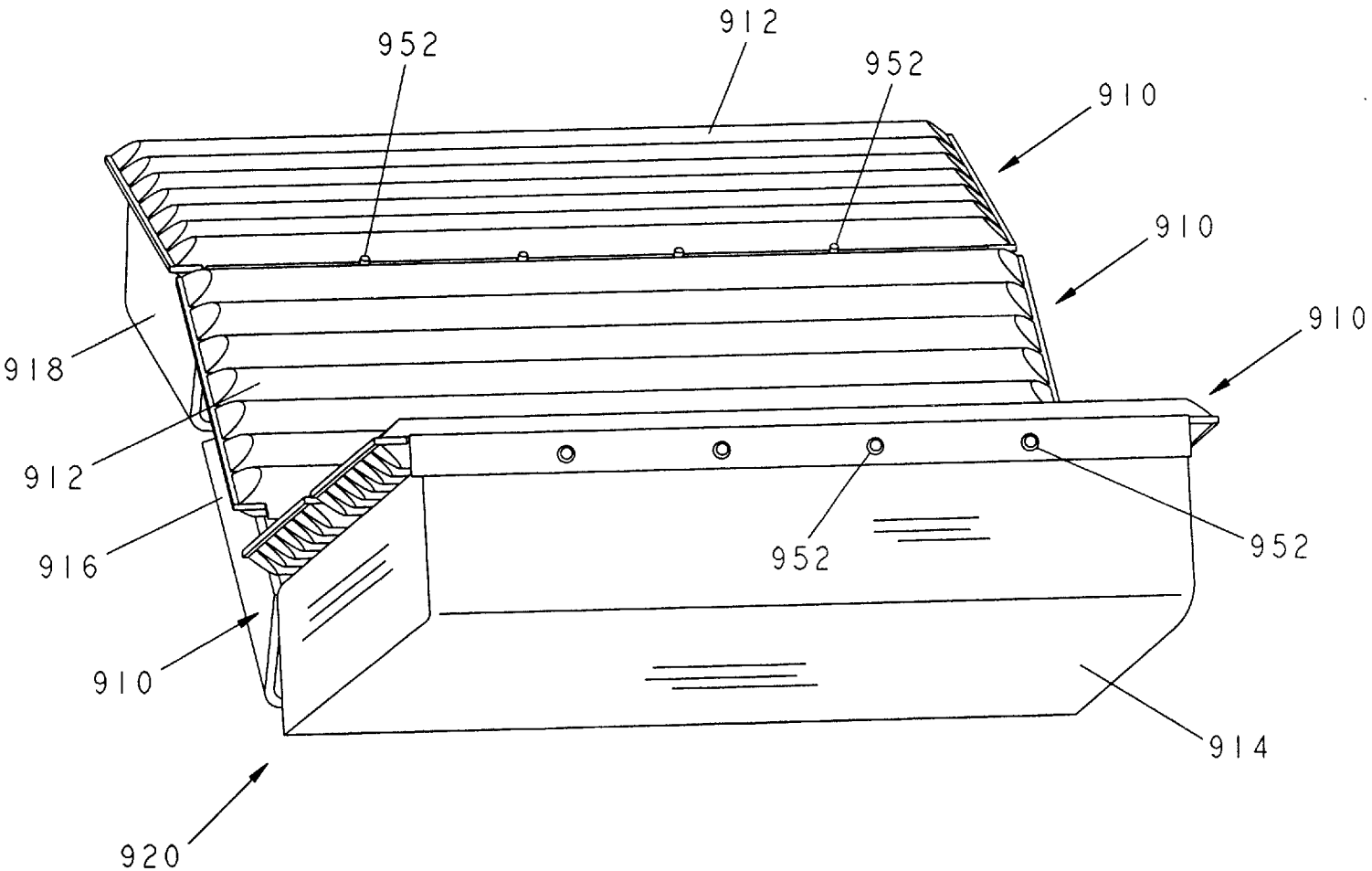
FIG. 57 is another perspective view of the bed of FIG. 53.

As shown in FIG. 53, each end of bladder units 910 includes a plurality of snaps 952 that fasten to the respective snaps 952 of an adjacent bladder unit 910. Head and leg sections 914, 918 of deck 920 also includes snaps 952 that fasten to the respective snaps 952 of the adjacent bladder units 910 to couple the series of bladder units 910 to deck 920 as shown in FIGS. 53 and 57.

Figure 61:
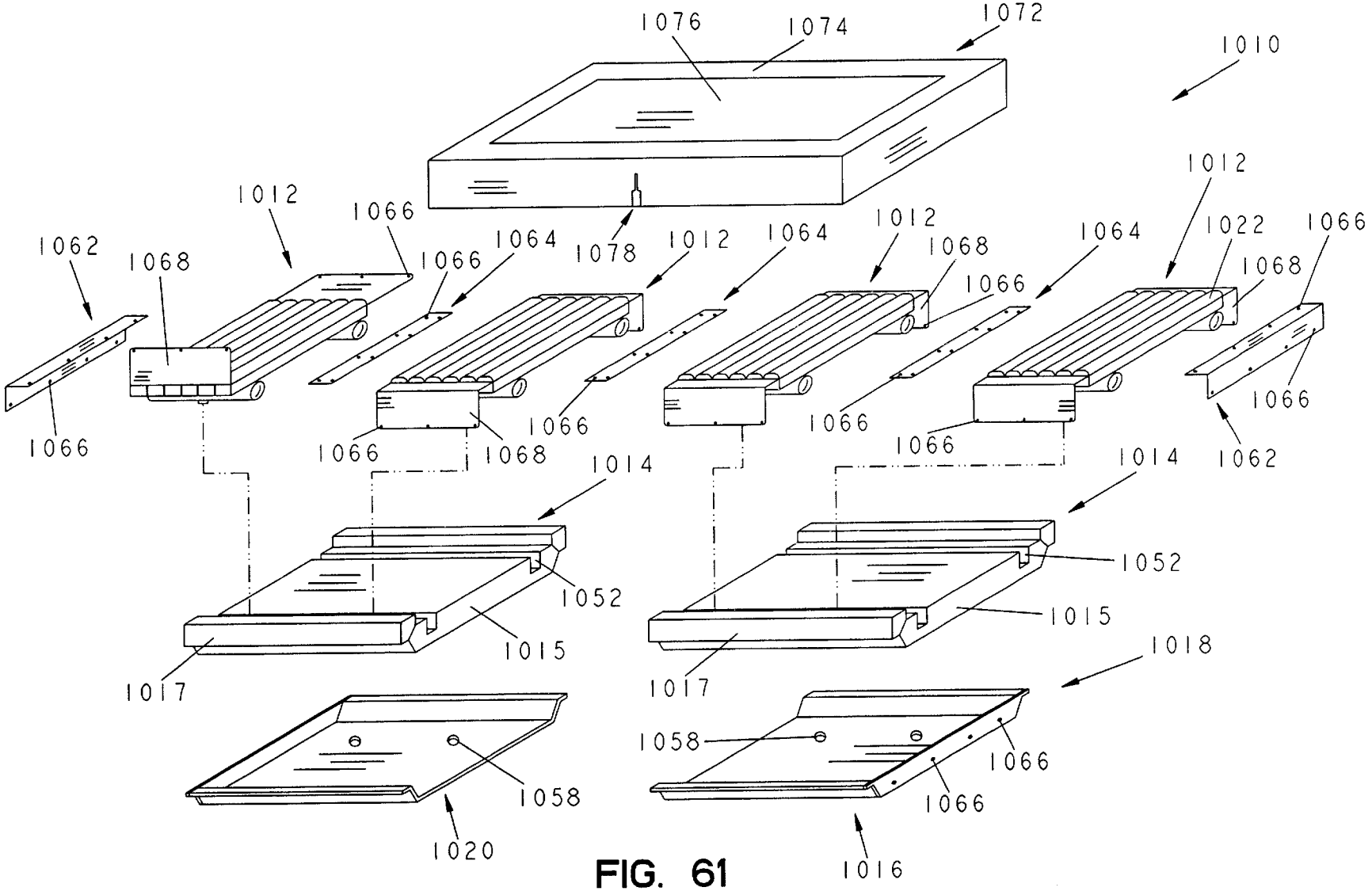
FIG. 61 is an assembly view of the mattress showing two form sections of the mattress positioned over two deck sections.

Referring now to FIG. 61, a mattress or support surface apparatus 1010 is provided having four air fluidized bladder units 1012 and two foam sections 1014. One of foam sections 1014 is positioned over a torso section 1016 of a step deck 1018 and the other foam section 1014 is positioned over a leg section 1020 of step deck 1018.

Figure 59:
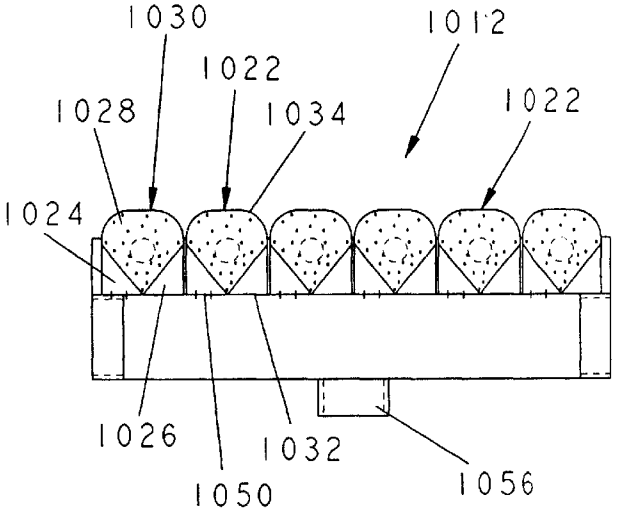
FIG. 59 is a sectional view of the bladder unit taken along line 59—59 of FIG. 58.

As shown in FIG. 59, each air fluidized bladder unit 1012 includes six air fluidized bladders 1022. Air fluidized bladder units 1012 are configured to maintain air fluidization within bladders 1022 as torso and leg sections 1016, 1018 are articulated. To accomplish this continuous air fluidization, each of bladders 1022 includes a first plenum 1024 and a second plenum 1026. A third fluidized zone 1028 contains a fluidizable medium. Each bladder 1022 further includes neck 1029 through which the fluidized medium is inserted and removed, if necessary, and a corresponding cap 1031 that closes neck 1029.

Bladders 1022 include an outer wall 1030 having a bottom air impermeable outer sheet 1032 and an upper air permeable outer sheet 1034. Plenums 1024, 1026 are formed by alternating diffusers 1036, 1038 of an air permeable and fluidizable medium impermeable diffuser sheet or diffuser apparatus 1040 coupled to impermeable outer sheet 1032.

Figure 58:
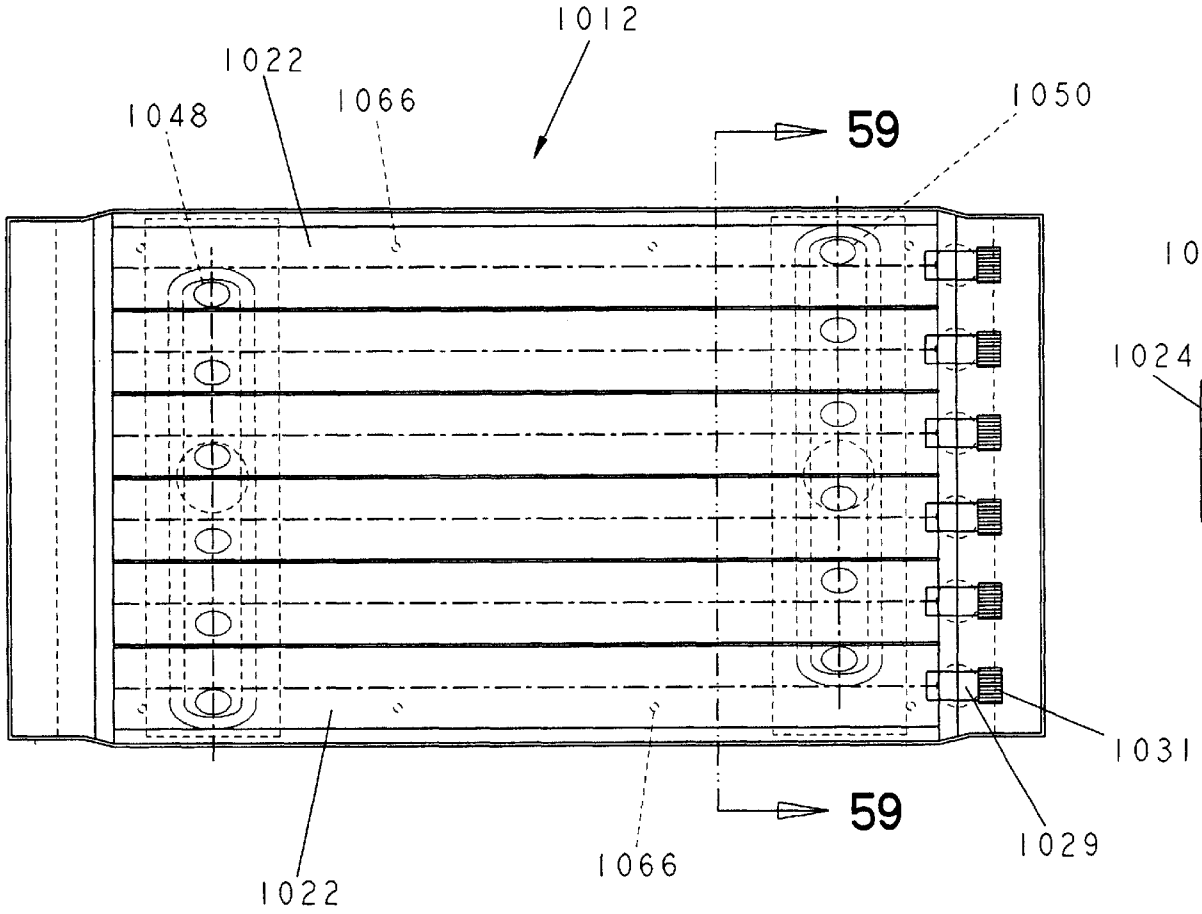
FIG. 58 is a top plan view of one of the fluidized bladder units of FIG. 53 showing the bladder unit including a plurality of transversely extending bladders.
Figure 60:
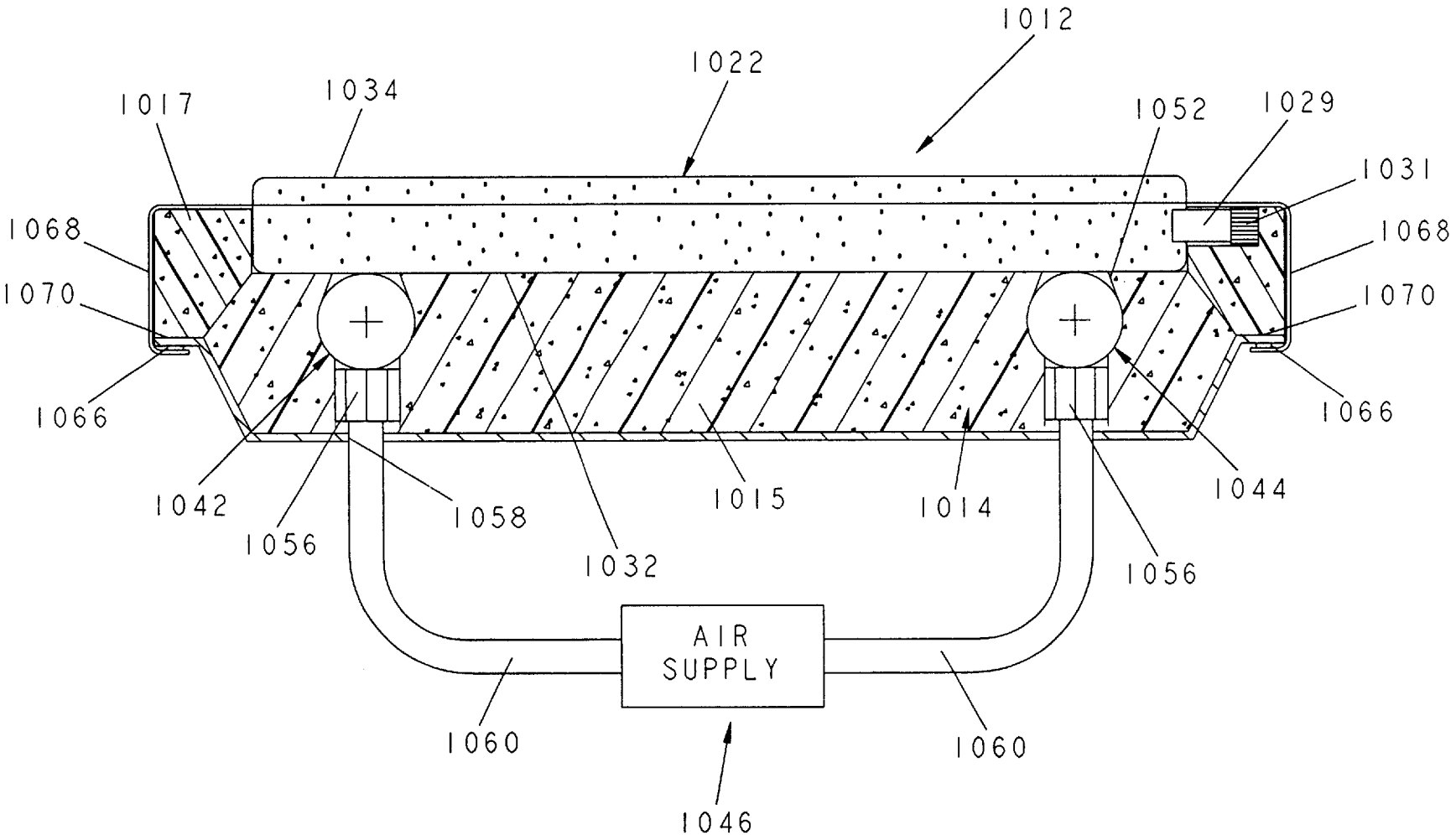
FIG. 60 is a side elevation view of the mattress showing the foam section positioned on the deck and including a pair of manifold-receiving channels and the bladder unit positioned on the foam.

A pair of air manifolds 1042, 1044 made of a compliant air impermeable sheet are provided, as shown in FIGS. 59 and 60, that are coupled to a blower or air supply 1046. Manifold 1042 provides pressurized air to first plenums 1024 and manifold 1044 provides pressurized air to second plenums 1026. Apertures 1048, 1050 are provided in bottom outer sheet 1032 that provides communication of air between respective manifolds 1042, 1044 and plenums 1024, 1026 as shown in FIGS. 58, 59.

As shown in FIGS. 60 and 61, foam sections 1014 each includes a soft foam base 1015 and a firm perimeter or fence 1017. Base 1015 includes a pair of grooves or channels 1052 sized to receive manifolds 1042, 1044 and apertures 1054 sized to receive fittings 1056 coupled to manifolds 1042, 1044. Similarly, deck sections 1016, 1020 include apertures

1058 sized to receive hoses 1060 coupled to fittings 1056 and air supply 1046.

Because bladders 1022, manifolds 1042, 1044, and foam sections 1014 are made of compliant material, if the supply of air is turned off, the patient will be supported by compliant materials. Thus, the patient will not "bottom out" on deck 1018 or another hard object even if the supply of air is interrupted.

In the embodiment of FIGS. 58–61, first and second plenums 1024, 1026 are aligned at about a 90° angle. Regardless of the position of torso and leg sections 1016, 1020 of deck 1018, manifolds 1042, 1044 provide air to each plenum 1024, 1026 so that air is provided in at least two directions to the fluidization zone at all times. According to alternative embodiments of the present disclosure, the supply of air to each manifold is shifted between the plenums in a manner similar to that described above. Because there are two diffusers 1036, 1038, air is directed from two directions at multiple points within the fluidization zone as described above.

It is understood that first and second plenums 1024, 1026 can be aligned at any suitable angles. In addition, more than two plenums may be used inside the bladders, if desired.

As shown in FIG. 61, mattress 1010 further includes a plurality of end webs 1062 and intermediate webs 1064 configured to couple bladder units 1012 to deck 1018 and to each adjacent bladder unit 1012. Each end web 1062 includes a plurality of snaps 1066 positioned to couple to snaps 1066 on head and foot sections 1016, 1020 of deck 1018 and the adjacent bladder units 1012. Similarly, each intermediate web 1064 includes snaps 1066 positioned to couple to snaps 1066 on the adjacent bladder units 1012. Thus, each bladder unit 1012 is coupled to the adjacent bladder unit 1012 or deck section 1016, 1020.

As shown in FIGS. 60 and 61, each bladder unit 1012 further includes a pair of end flaps 1068 that are configured to wrap around perimeter 1017 of foam section 1014. Each flap 1068 includes snaps 1066 that fasten to snaps 1066 coupled to an upper level 1070 of deck sections 1016, 1020.

Mattress 1010 further includes a cover 1072 configured to fit over air bladder units 1012 and a portion of deck sections 1016, 1020 of deck 1018. Cover 1072 includes a perimeter 1074 made of air and liquid impermeable material and a center sheet 1076 made of air permeable material and positioned over air bladders 1022 to permit air released from air bladders 1022 to flow through cover 1072. Perimeter 1074 is formed to include a slit 1078 that permits cover 1072 to fold when deck 1018 is articulated.

It is understood that the diffusers described in the present application may be made from any suitable material to permit controlled air flow and block flow of the fluidizable medium. For instance, the diffuser may be made from cloth, wood fiber, plastic, or other suitable material. In addition, the diffuser may be made from an air impermeable cloth punched with holes in a predetermined pattern and having a filter sheet located over the holes. Valves to control air supply to the different zones may be electrical valves controlled by mechanical motors, stepper motors, or solenoids. In addition, mechanical valves having geared motors or linkages may be used. Air valve adjustment may be made through electronic feedback control or suitable mechanical linkages.

Although the invention has been described in detail with reference to certain illustrated embodiments, variations and modifications exist within the scope and spirit of the present invention as described and defined in the following claims.

What is claimed is:

1. A fluidized air bladder for use with a bedframe, the fluidized bladder comprising an outer wall, a plurality of diffusers cooperating with the outer wall to define a boundary of a fluidized zone, and a fluidizable medium positioned in the fluidized zone, the plurality of diffusers each being configured to provide air to the fluidized zone to fluidize the fluidizable medium.

2. The fluidized air bladder of claim 1, wherein the plurality of diffusers include a convex surface that cooperates with the outer wall to define the fluidized zone.

3. The fluidized air bladder of claim 2, wherein the plurality of diffusers are cylindrical.

4. The fluidized air bladder of claim 1, wherein the plurality of diffusers cooperate to define a concave diffuser surface.

5. The fluidized air bladder of claim 4, wherein the concave diffuser surface is substantially V-shaped.

6. The fluidized air bladder of claim 1, wherein the flow of air provided to the plurality of diffusers is adjusted based on movement of the bedframe.

7. The fluidized air bladder of claim 6, wherein the flow of air through a first of the plurality of diffusers is decreased as a result of movement of the bedframe and the flow of air through a second of the plurality of diffusers is increased as a result of movement of the bedframe.

8. The fluidized air bladder of claim 1, wherein the plurality of diffusers are spaced apart.

9. The fluidized air bladder of claim 1, wherein the plurality of diffusers cooperate with the outer wall to define a plurality of plenums supplying air to the plurality of diffusers from an air supply.

10. The fluidized air bladder of claim 1, wherein the plurality of diffusers are made from a single sheet of air permeable material.

11. A fluidized air bladder for use with a bedframe, the fluidized bladder comprising an outer wall, a diffuser apparatus cooperating with the outer wall to define a boundary of a fluidized zone, and a fluidizable medium positioned in the fluidized zone, the diffuser apparatus being configured to provide air to fluidize the fluidizable medium in a first flow direction, the diffuser apparatus being configured to provide air to fluidize the fluidizable medium in a second flow direction, the first and second flow directions cooperating to define an angle therebetween of more than 60 degrees, the diffuser apparatus providing air simutaneously in the first and second flow directions.

12. The fluidized air bladder of claim 11, wherein the diffuser apparatus includes a first diffuser providing air to the fluidized zone in the first flow direction and a second diffuser providing air to the fluidized zone in the second flow direction.

13. The fluidized air bladder of claim 12, wherein the first diffuser includes a substantially flat sheet through which the air is provided to the fluidized zone in the first direction and the second diffuser includes a second substantially flat sheet through which the air is provided to the fluidized zone in the second direction.

14. The fluidized air bladder of claim 12, wherein the first diffuser includes a convex surface providing air to the fluidized zone in the first direction and the second diffuser includes a convex surface providing air to the fluidized zone in the second direction.

15. The fluidized air bladder of claim 11, wherein the angle defined between the first and second flow directions is approximately 90°.

16. The fluidized air bladder of claim 11, wherein the diffuser apparatus defines a concave diffuser surface.

17. The fluidized air bladder of claim 16, wherein the concave diffuser surface is substantially V-shaped.

18. The fluidized air bladder of claim 11, wherein the plurality of diffusers cooperate with the outer wall to define a plurality of plenums supplying air to the plurality of diffusers from an air supply.

19. A fluidized air bladder for use with a bedframe, the fluidized bladder comprising an outer wall, a diffuser apparatus cooperating with the outer wall to define a fluidized zone, and a fluidizable medium positioned in the fluidized zone, the diffuser apparatus being configured to provide air to the fluidized zone to fluidize the fluidizable medium, a portion of the air leaving the diffuser apparatus in a first flow direction passing through a point in the fluidized zone, another portion of the air leaving the diffuser apparatus in a second flow direction passing through the point, the diffuser providing air simultaneously in the first and second flow directions.

20. The fluidized air bladder of claim 19, wherein the diffuser apparatus includes a first diffuser providing air to the fluidized zone in the first flow direction and a second diffuser providing air to the fluidized zone in the first flow direction.

21. The fluidized air bladder of claim 19, wherein the point in the fluidized zone is positioned in the center of the fluidized zone.

22. The fluidized air bladder of claim 19, wherein the point in the fluidized zone is positioned adjacent to the outer wall.

23. The fluidized air bladder of claim 19, wherein the diffuser apparatus is configured to provide air to the fluidized zone a plurality of first flow directions passing through a plurality of points in the fluidized zone, the diffuser apparatus is configured to provide air to the fluidized zone in a plurality of second flow directions passing through the plurality of points.

24. The fluidized air bladder of claim 23, wherein the plurality of first flow directions are substantially parallel and the plurality of second flow directions are substantially parallel.

25. The fluidized air bladder of claim 23, wherein the plurality of first flow directions emanate from a single point and the plurality of second flow directions emanate from a single point.

26. The fluidized air bladder of claim 23, wherein the plurality of points are positioned adjacent to the outer wall.

27. A fluidized air bladder for use with a bedframe having an articulating deck including a deck section configured to move from a first substantially horizontal position to an inclined position of at least 60°, the fluidized bladder comprising an outer wall, a diffuser apparatus cooperating with the outer wall to define a fluidized zone, and a fluidizable medium positioned in the fluidized zone, the diffuser apparatus being configured to provide air to the fluidized zone in a substantially vertical direction when the deck section is in 60 ° the inclined position to maintain the fluidization of the fluidizable medium.

28. The air fluidized air bladder of claim 27, further comprising a mechanism configured to rotate the diffuser relative to the deck section upon movement of the deck section.

29. The air fluidized air bladder of claim 27, wherein the diffuser apparatus includes a first diffuser configured to provide air to the fluidized zone when the deck section is in the substantially vertical position and a second diffuser configured to provide air to the fluidized zone when the deck section is in the inclined position.

30. The fluidized air bladder of claim 27, wherein the diffuser apparatus includes a concave diffuser surface providing air to the fluidized zone.

31. The fluidized air bladder of claim 27, wherein the outer wall includes a plurality of laterally spaced-apart apertures adapted to receive pressurized air from a pressure source.

32. The fluidized air bladder of claim 27, wherein the diffuser apparatus cooperates with the outer wall to define a plurality of plenums.

33. The fluidized air bladder of claim 27, wherein the diffuser apparatus includes a diffuser surface adapted to be in a substantially horizontal orientation when the deck section is in the inclined position.

34. A fluidized air bladder for use with a bedframe having an articulating deck including a deck section configured to move from a first substantially horizontal position to an inclined position of at least 15°, the fluidized air bladder comprising an outer wall defining an interior region having a fluidized zone, a fluidizable medium positioned in the fluidized zone, and means for providing air to the fluidized zone to fluidize the fluidizable medium, the providing means being configured to maintain at least a portion of the air flow in a substantially vertical direction through a central portion of the fluidized zone when the deck is in the inclined position.

35. The fluidized air bladder of claim 34, wherein the providing means includes a plurality of diffusers that cooperate with the outer wail to define the fluidized zone and the plurality of diffusers are configured to provide air to the fluidized zone.

36. The fluidized air bladder of claim 34, wherein the providing means includes a diffuser having a convex surface configured to provide air to the fluidized zone.

37. The fluidized air bladder of claim 34, wherein the providing means cooperates with the outer wall to define a plurality of spaced-apart plenums adapted to receive pressurized air from a pressure source.

38. The fluidized air bladder of claim 37, wherein the outer wall includes a plurality of laterally spaced-apart apertures adapted to provide air to the plurality of spaced-apart plenums from the pressure source.

* * * * *